US011213728B2

(12) United States Patent
Greaney et al.

(10) Patent No.: US 11,213,728 B2
(45) Date of Patent: Jan. 4, 2022

(54) GOLF CLUB HEAD AND GOLF CLUB

(71) Applicant: Taylor Made Golf Company, Inc., Carlsbad, CA (US)

(72) Inventors: Mark Vincent Greaney, Vista, CA (US); John Francis Lorentzen, El Cajon, CA (US); Matthew Greensmith, Vista, CA (US); Craig Richard Slyfield, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 17/143,527

(22) Filed: Jan. 7, 2021

(65) Prior Publication Data

US 2021/0146203 A1 May 20, 2021

Related U.S. Application Data

(63) Continuation of application No. 16/258,848, filed on Jan. 28, 2019, now Pat. No. 10,888,746, which is a continuation of application No. 15/263,929, filed on Sep. 13, 2016, now Pat. No. 10,195,497.

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08)

(58) Field of Classification Search
CPC ..... A63B 53/0466; A63B 53/0408; A63B 53/0412
USPC ..... 473/324–350, 287–292
See application file for complete search history.

(56) References Cited

U.S. PATENT DOCUMENTS 5,851,160 A * 12/1998 Rugge ..... A63B 53/04 473/349
5,935,020 A 8/1999 Stites et al.
6,139,445 A * 10/2000 Werner ..... A63B 53/047 473/330
6,340,337 B2 * 1/2002 Hasebe ..... A63B 53/04 473/349
6,565,452 B2 5/2003 Helmstetter et al.
6,902,497 B2 6/2005 Deshmukh et al.
6,939,247 B1 * 9/2005 Schweigert ..... A63B 60/42 473/314
6,991,558 B2 1/2006 Beach et al.
(Continued)

*Primary Examiner* — Sebastiano Passaniti
(74) *Attorney, Agent, or Firm* — Dawsey Co., LPA; David Dawsey

(57) ABSTRACT

A golf club head and golf club having a large volume, large head dimensions, and/or large face characteristics, as well as unique mass property attributes driven by relationships not often considered in conventional club head design, to achieve a resistance to squaring the club head during a golf swing that is comfortable to the novice golfer, stability during off-center impacts, and preferred launch characteristics. This is achieved in part via establishing a club head configuration and associated center of gravity location that results in a preferred magnitude of Delta1 and Delta2 values, CG angle, moments of inertia, and associated ratios, relationships, and club head mass property characteristics influenced by these variables, to account for the scale of the club head and achieve improved performance.

20 Claims, 7 Drawing Sheets

(56) References Cited

U.S. PATENT DOCUMENTS 7,166,038 B2 * 1/2007 Williams ..... A63B 53/0466 473/329
7,407,447 B2 8/2008 Beach
7,419,441 B2 9/2008 Hoffman
7,628,713 B2 * 12/2009 Tavares ..... A63B 53/0466 473/345
7,731,603 B2 * 6/2010 Beach ..... A63B 60/00 473/335
7,753,806 B2 7/2010 Beach et al.
8,012,038 B1 9/2011 Beach et al.
8,012,039 B2 * 9/2011 Greaney ..... A63B 60/00 473/329
8,096,897 B2 1/2012 Beach
8,444,504 B2 5/2013 Chao et al.
8,663,029 B2 * 3/2014 Beach ..... A63B 60/00 473/334
8,747,250 B2 6/2014 Chao et al.
8,777,776 B2 7/2014 Wahl et al.
8,827,831 B2 * 9/2014 Burnett ..... A63B 60/50 473/329
8,876,627 B2 11/2014 Beach et al.
9,033,821 B2 5/2015 Beach et al.
9,089,745 B2 7/2015 Greaney et al.
9,174,099 B2 11/2015 Greaney et al.
9,192,824 B1 11/2015 Frame et al.
9,199,138 B2 12/2015 Willett et al.
9,216,326 B2 12/2015 Beach et al.
9,216,331 B2 12/2015 Greensmith et al.
9,220,953 B2 * 12/2015 Beach ..... A63B 60/00
9,259,625 B2 2/2016 Sargent et al.
9,278,262 B2 3/2016 Sargent et al.
9,278,267 B2 3/2016 Chao et al.
9,358,436 B2 6/2016 Sargent et al.
9,399,157 B2 7/2016 Greensmith et al.
9,409,066 B2 8/2016 Lin
9,427,637 B2 8/2016 Beach
9,452,324 B2 9/2016 Beach
9,452,325 B2 9/2016 DeShiell
9,452,327 B2 9/2016 Willett
9,457,243 B2 10/2016 Lorentzen
9,468,816 B2 10/2016 Barelmann
9,468,817 B2 10/2016 Beach
9,474,947 B2 10/2016 Willett
9,504,886 B2 11/2016 Albertsen
9,561,413 B2 2/2017 Nielson
9,566,479 B2 2/2017 Albertsen
9,566,482 B2 2/2017 Beach
9,610,482 B2 4/2017 Burnett
9,623,295 B2 4/2017 Willett
9,630,068 B2 4/2017 Beach
9,656,131 B2 5/2017 Burnett
9,662,545 B2 5/2017 Beach
9,675,849 B2 6/2017 Beach
9,682,291 B2 6/2017 Chao
9,682,294 B2 6/2017 Burnett
9,694,252 B2 7/2017 Beach
9,694,253 B2 7/2017 Greaney
9,700,763 B2 7/2017 Harbert
9,700,769 B2 7/2017 Beach
9,707,457 B2 7/2017 Mata
9,750,991 B2 9/2017 Chao
9,764,204 B2 9/2017 Beach
9,776,053 B2 10/2017 Burnett
9,789,372 B2 10/2017 Beach
9,795,846 B2 10/2017 Sargent
9,814,953 B2 11/2017 Sargent
9,844,708 B2 12/2017 Greaney
9,861,864 B2 1/2018 Beach
9,868,036 B1 1/2018 Kleinert
9,914,027 B1 3/2018 Harbert
9,919,190 B2 3/2018 Beach
9,943,734 B2 4/2018 James
10,016,662 B1 7/2018 Wester
10,035,049 B1 7/2018 Neilson
10,046,212 B2 8/2018 Sargent
10,065,083 B2 9/2018 Beach
10,076,688 B1 9/2018 Harbert
10,086,240 B1 10/2018 Hoffman
10,112,085 B2 10/2018 Beach
10,150,016 B2 12/2018 Willett
10,183,202 B1 1/2019 Harbert
10,195,497 B1 2/2019 Greaney et al.
10,556,158 B1 2/2020 Harbert
10,569,144 B2 2/2020 Nielson
10,646,755 B1 5/2020 Kleinert
10,688,352 B2 6/2020 Harbert
10,843,048 B1 11/2020 Hoffman
10,874,914 B2 12/2020 Johnson
10,888,746 B1 * 1/2021 Greaney ..... A63B 53/0466
2002/0160854 A1 10/2002 Beach et al.
2005/0059508 A1 * 3/2005 Burnett ..... A63B 60/00 473/349
2005/0239576 A1 10/2005 Stites et al.
2009/0105010 A1 4/2009 De La Cruz et al.
2011/0177880 A1 7/2011 Schweigert
2014/0128176 A1 5/2014 Chao
2014/0155194 A1 6/2014 Beach et al.
2014/0171216 A1 6/2014 Lin et al.
2014/0235369 A1 8/2014 Willett et al.
2014/0256464 A1 9/2014 Chao et al.
2014/0274446 A1 9/2014 Greaney et al.
2014/0274457 A1 9/2014 Beach et al.
2014/0295990 A1 10/2014 Beach et al.
2014/0323236 A1 10/2014 Burnett et al.
2014/0323239 A1 10/2014 Beach et al.
2015/0018115 A1 1/2015 Beach et al.
2015/0024870 A1 1/2015 Beach et al.
2015/0038258 A1 2/2015 Beach et al.
2015/0038262 A1 2/2015 DeShiell et al.
2015/0045138 A1 2/2015 Beach et al.
2015/0105177 A1 4/2015 Beach et al.
2015/0148149 A1 5/2015 Beach et al.
2015/0151174 A1 6/2015 Greaney et al.
2015/0165284 A1 6/2015 Willett et al.
2015/0174460 A1 6/2015 Beach et al.
2015/0182818 A1 7/2015 James et al.
2015/0182822 A1 7/2015 Burnett et al.
2015/0224374 A1 8/2015 Greaney et al.
2015/0246269 A1 9/2015 Lorentzen et al.
2015/0306471 A1 10/2015 Albertsen et al.
2015/0375070 A1 12/2015 Beach et al.
2016/0001146 A1 1/2016 Sargent et al.
2016/0008682 A1 1/2016 Beach et al.
2016/0008687 A1 1/2016 Sargent et al.
2016/0016054 A1 1/2016 Burnett et al.
2016/0023060 A1 1/2016 Harbert et al.
2016/0023061 A1 1/2016 Beach et al.
2016/0023062 A1 1/2016 Willett et al.
2016/0023063 A1 1/2016 Willett et al.
2016/0023065 A1 1/2016 Albertsen et al.
2016/0059093 A1 3/2016 Nielson et al.
2016/0059094 A1 3/2016 Mata et al.
2016/0067562 A1 3/2016 Beach et al.
2016/0136488 A1 5/2016 Willett et al.
2016/0136490 A1 5/2016 Sargent et al.
2016/0144249 A1 5/2016 Burnett et al.
2016/0184662 A1 6/2016 Barelmann et al.
2016/0243414 A1 8/2016 Greaney et al.
2020/0324177 A1 10/2020 Harbert

* cited by examiner

GOLF CLUB HEAD AND GOLF CLUB

CROSS-REFERENCE TO RELATED APPLICATIONS

This application is a continuation of U.S. nonprovisional application Ser. No. 16,258,848, filed on Jan. 28, 2019, which is a continuation of U.S. nonprovisional application Ser. No. 15/263,929, filed on Sep. 13, 2016, now U.S. Pat. No. 10,195,497, all of which is incorporated by reference as if completely written herein.

FIELD

The present application is directed to embodiments of golf clubs and golf club heads, particularly oversized club heads.

BACKGROUND

Golf club head manufacturers and designers seek to improve certain performance characteristics such as forgiveness, playability, feel, and sound. In addition, the aesthetic of the golf club head must be maintained while the performance characteristics are enhanced. Golf club manufacturers often must choose to improve one performance characteristic at the expense of another. In fact, the incorporation of new technologies that improve performance may necessitate changes to other aspects of a golf club head so that the features work together rather than reduce the associated benefits. Further, it is often difficult to identify the tradeoffs and changes that must be made to ensure aspects of the club head work together to achieve the desired performance.

In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

The United States Golf Association (USGA) regulations constrain golf club head shapes, sizes, and moments of inertia. Due to these constraints, golf club manufacturers and designers struggle to produce a club having maximum size and moment of inertia characteristics while maintaining other desirable head characteristics, and designers have narrowed their research box to focus on ways to improve performance within these constraints. However, once a designer makes the decision to design outside of these USGA constraints, they are faced with a myriad of design considerations that do not arise when operating within the comfortable constraints they have worked within for years. In fact, many of the technical relationships found to improve performance while operating within the constraints do not improve, and may negatively influence, performance of a golf club head that is significantly larger. The disclosed embodiments tackle these issues.

SUMMARY

An oversized golf club head and golf club having a large volume, large head dimensions, and/or large face characteristics, as well as unique mass property attributes driven by relationships not often considered in conforming club head design, to achieve a resistance to squaring the oversized club head during a golf swing that is comfortable to the novice golfer, a feel similar to a non-oversized golf club, stability during off-center impacts, and preferred launch characteristics. This is achieved in part via establishing a club head configuration and associated center of gravity location that results in a preferred magnitude of Delta1 and Delta2 values, CG angle, moments of inertia, and associated ratios, relationships, and club head mass property characteristics influenced by these variables, to account for the significant scale of the oversized club head and achieve improved performance. The foregoing and other features and advantages of the invention will become more apparent from the following detailed description, which proceeds with reference to the accompanying figures.

BRIEF DESCRIPTION OF THE DRAWINGS

Without limiting the scope of the present invention as claimed below and referring now to the drawings and figures:

Figure 1:
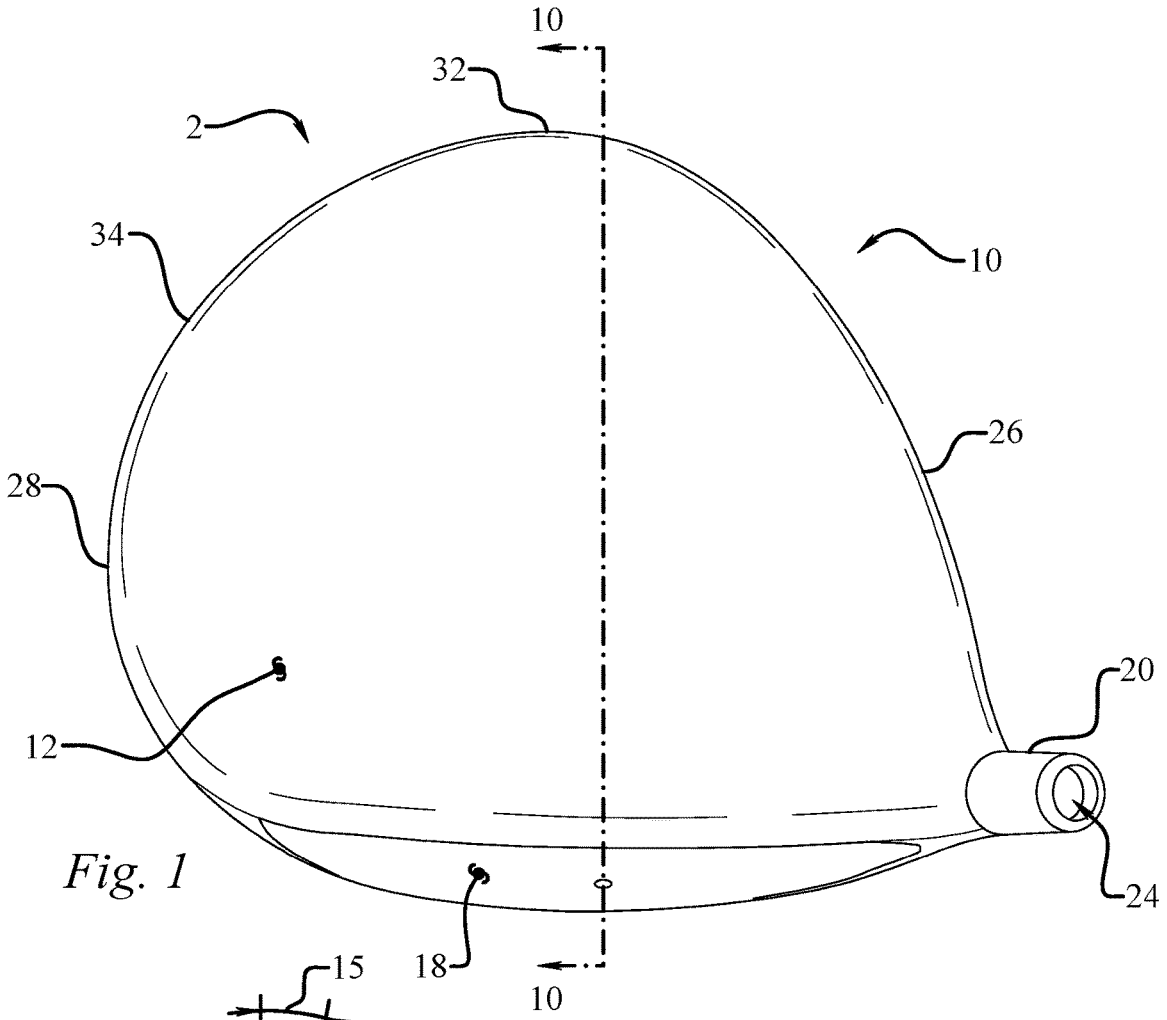
FIG. 1 is a top plan view of an embodiment of an oversized golf club head.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION

The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." The preferred embodiments of the invention accomplish the stated objectives by new and novel arrangements of elements and configurations, materials, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. All publications, patent applications, patents, and other references mentioned herein are incorporated herein by reference in their entireties. Even though the embodiments of this disclosure are particularly suited as oversized golf club heads and oversized golf clubs and reference is made specifically thereto, it should be immediately apparent that embodiments of the present disclosure are applicable to non-oversized club heads as well.

The following disclosure describes embodiments of golf club heads for oversized metalwood type golf clubs. Several of the golf club heads incorporate features that provide the golf club heads and/or golf clubs with oversized volume and/or dimensions and unique relationships providing improved performance associated with club head constructions that provide unique and preferential mass properties for an oversized club head 2, as well as unique dimensional configurations, unique face designs, higher coefficients of restitution ("COR") and characteristic times ("CT"), and/or impart preferred launch conditions upon a golf ball, including, but not limited to, decreased backspin rates, relative to other golf club heads that have come before. The disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 2:
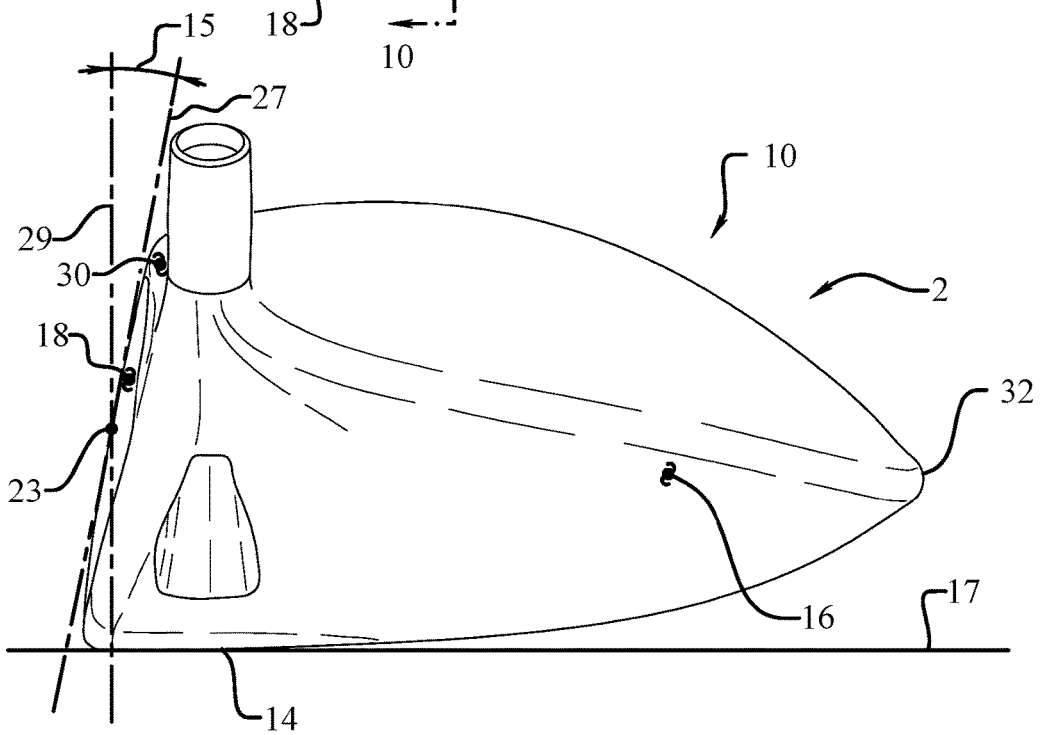
FIG. 2 is a side elevation view of an embodiment of an oversized golf club head.
Figure 3:
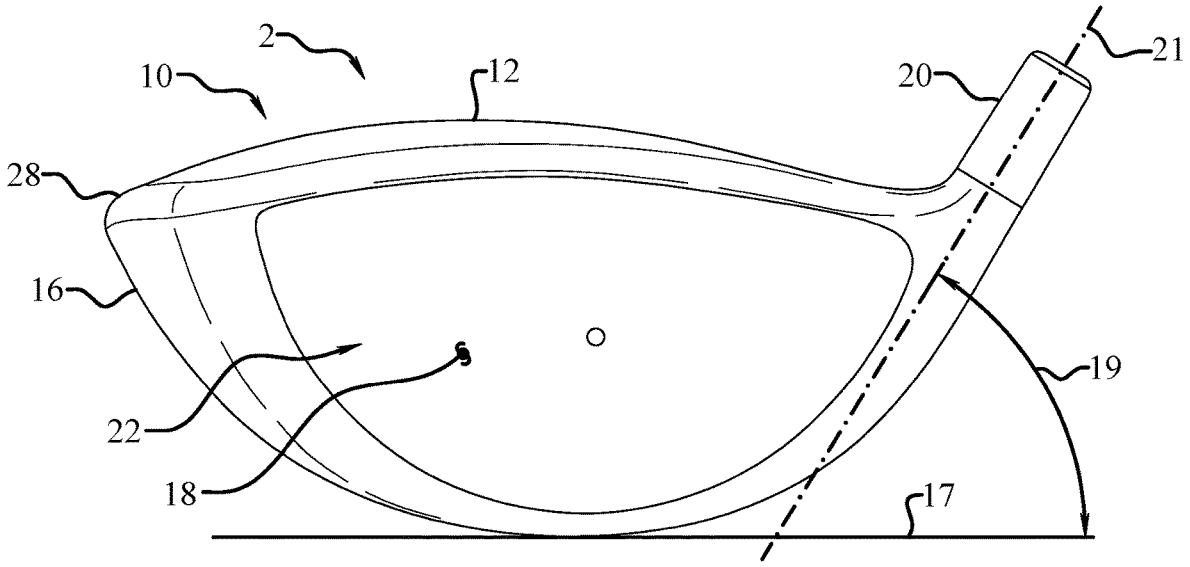
FIG. 3 is a front elevation view of an embodiment of an oversized golf club head.
Figure 4:
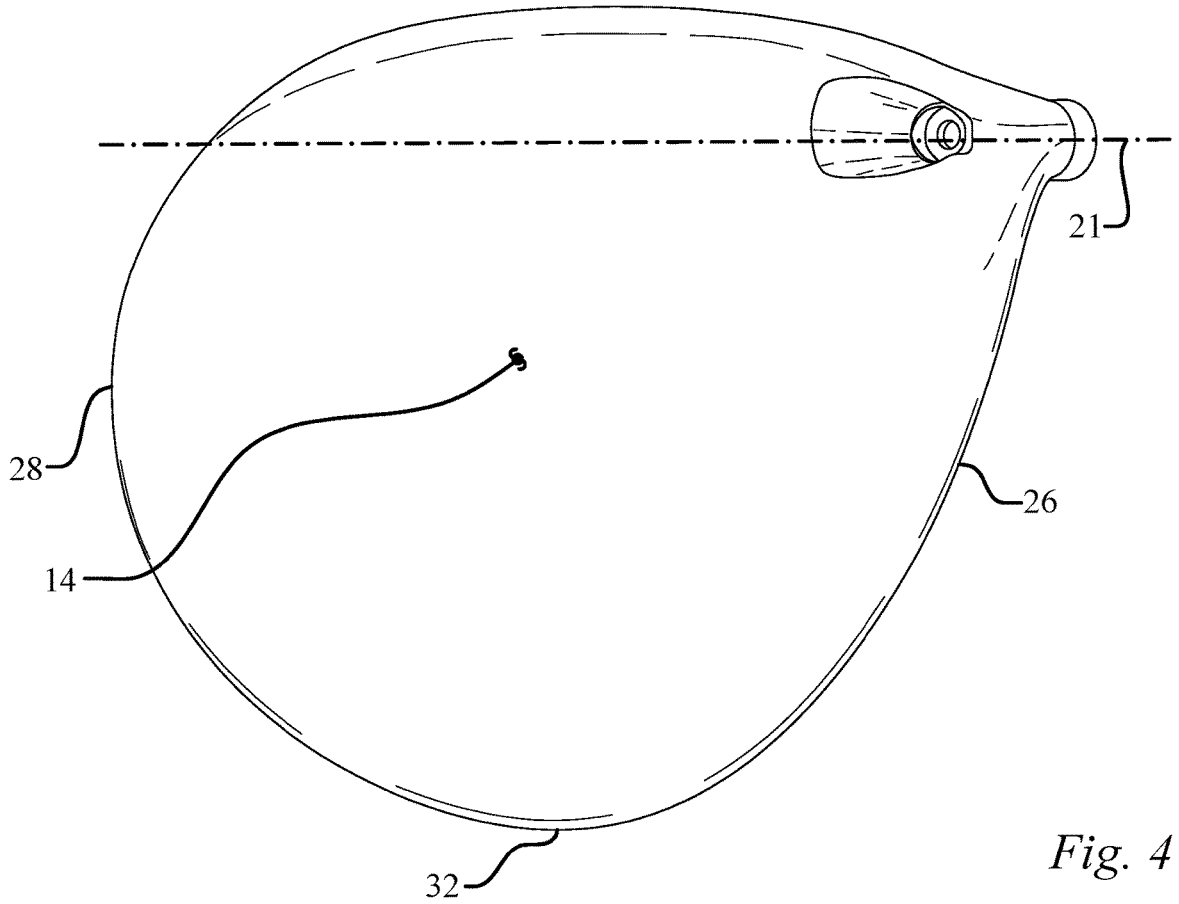
FIG. 4 is a bottom plan view of an embodiment of an oversized golf club head.
Figure 5:
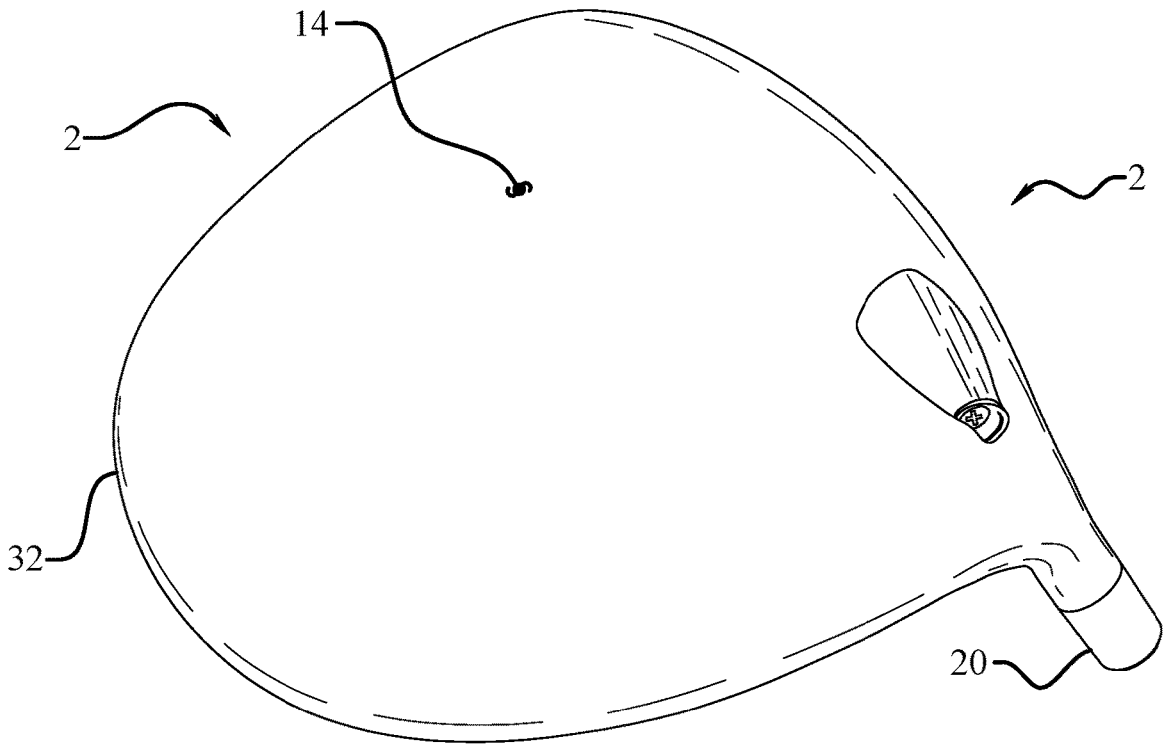
FIG. 5 is a bottom perspective view of an embodiment of an oversized golf club head.

FIGS. 1-4 illustrate one embodiment of a golf club head at normal address position. FIG. 1 illustrates a top plan view of the club head 2, FIG. 2 illustrates a side elevation view from the toe side of the club head 2, FIG. 3 illustrates a front elevation view, and FIG. 4 illustrates a bottom plan view of the club head 2. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect.

Club Head Generally

A golf club head, such as the oversized golf club head 2, includes a hollow body 10 defining a crown portion 12, a sole portion 14 and a skirt portion 16. A striking face, or face portion, 18 attaches to the body 10, or may be formed with a portion of the body 10. The body 10 can include a hosel 20, which defines a hosel bore 24 adapted to receive a golf club shaft and/or a shaft sleeve. The body 10 further includes a heel portion 26, a toe portion 28, a front portion 30, and a rear portion 32.

The oversized club head 2 also has a volume, typically measured in cubic-centimeters ($cm^3$), often abbreviated as "cc", equal to the volumetric displacement of the oversized club head 2, assuming any apertures are sealed by a substantially planar surface. (See United States Golf Association "Procedure for Measuring the Club Head Size of Wood Clubs," Revision 1.0, Nov. 21, 2003). In some implementations, the oversized golf club head 2 has a volume between approximately 500 $cm^3$ and approximately 1100 $cm^3$, and a total mass between approximately 185 g and approximately 215 g, as will be described in greater detail within the "Oversized Golf Club Heads and Golf Clubs" section. Additional specific implementations having additional specific values for volume and mass are described elsewhere herein.

As used herein, "crown" means an upper portion of the oversized club head 2 above a peripheral outline 34 of the oversized club head 2 as viewed from a top-down direction and rearward of the topmost portion of the striking face 18, as seen in FIG. 1. As used herein, "sole" means a lower portion of the oversized club head 2 extending upwards from a lowest point of the oversized club head 2 when the oversized club head 2 is at the normal address position. Further, the sole 14 can define a substantially flat portion extending substantially horizontally relative to the ground 17 when in the normal address position. In some implementations, the bottommost portion of the sole 14 extends substantially parallel to the ground 17 between approximately 5% and approximately 70% of the depth Dch of the body 10. In some implementations, an adjustable mechanism is provided on the sole 14 to "decouple" the relationship between face angle and hosel/shaft loft, i.e., to allow for separate adjustment of square loft and face angle of the oversized club head 2. For example, some embodiments of the oversized club head 2 include an adjustable sole portion that can be adjusted relative to the body 10 to raise and lower the rear end of the oversized club head 2 relative to the ground. The oversized club head 2 may include adjustability aspects disclosed in U.S. patent application Ser. No. 14/734,181, which is incorporated herein by reference. As used herein, "skirt" means a side portion of the oversized club head 2 between the crown 12 and the sole 14 that extends across the periphery 34 of the oversized club head 2, excluding the face 18, from the toe portion 28, around the rear portion 32, to the heel portion 26.

As used herein, "striking surface" means a front or external surface of the striking face 18 configured to impact a golf ball (not shown). As will be described later in greater detail, in some embodiments the striking face or face portion 18 can be a striking plate attached to the body 10 using conventional attachment techniques, such as welding, and in other embodiments the face portion 18 may include an insert, which may be metallic or non-metallic, and in even further embodiment the face portion 18 is formed integral with a portion of one or more of the crown 12, sole 14, and skirt. Thus, one embodiment incorporates a cup-face construction whereby the face portion 18 is integrally formed, by casting, forging, stamping, or pressing, with a return portion that forms a portion of one or more of the crown 12, sole 14, and skirt. In a further embodiment at least 50% of the perimeter of the face portion 18 has an associated return portion and at least a portion of the return portion extends away from the face portion 18 a return distance that is at least ½ inch, while in another embodiment the return distance is no more than 2 inches. The striking surface 18 may have a bulge and roll curvature, disclosed in great detail later herein.

The body 10 may comprise a polymeric material, a metal alloy (e.g., an alloy of titanium, an alloy of steel, an alloy of aluminum, and/or an alloy of magnesium), a composite material, such as a graphitic composite, a ceramic material, or any combination thereof (e.g., a metallic sole and skirt with a composite, magnesium, or aluminum crown). Embodiments of the oversized club head 2 may include any of the materials and configurations disclosed in U.S. patent application Ser. Nos. 14/717,864, 15/233,805, 15/087,002, and 62/205,601, which is incorporated herein by reference. In some embodiments the crown 12, sole 14, and skirt 16 may be integrally formed using techniques such as molding, cold forming, casting, and/or forging and the striking face 18 can be attached to the crown 12, sole 14, and skirt 16 by known means, while in other embodiments the striking face 18 is integrally formed with a portion of the crown 12, sole 14, and/or skirt 16. For example, in some embodiments, the body 10 can be formed from a cup-face structure, with a wall or walls extending rearward from the edges of the inner striking face surface and the remainder of the body formed as a separate piece that is joined to the walls of the cup-face by welding, cementing, adhesively bonding, or other technique known to those skilled in the art.

Figure 7:
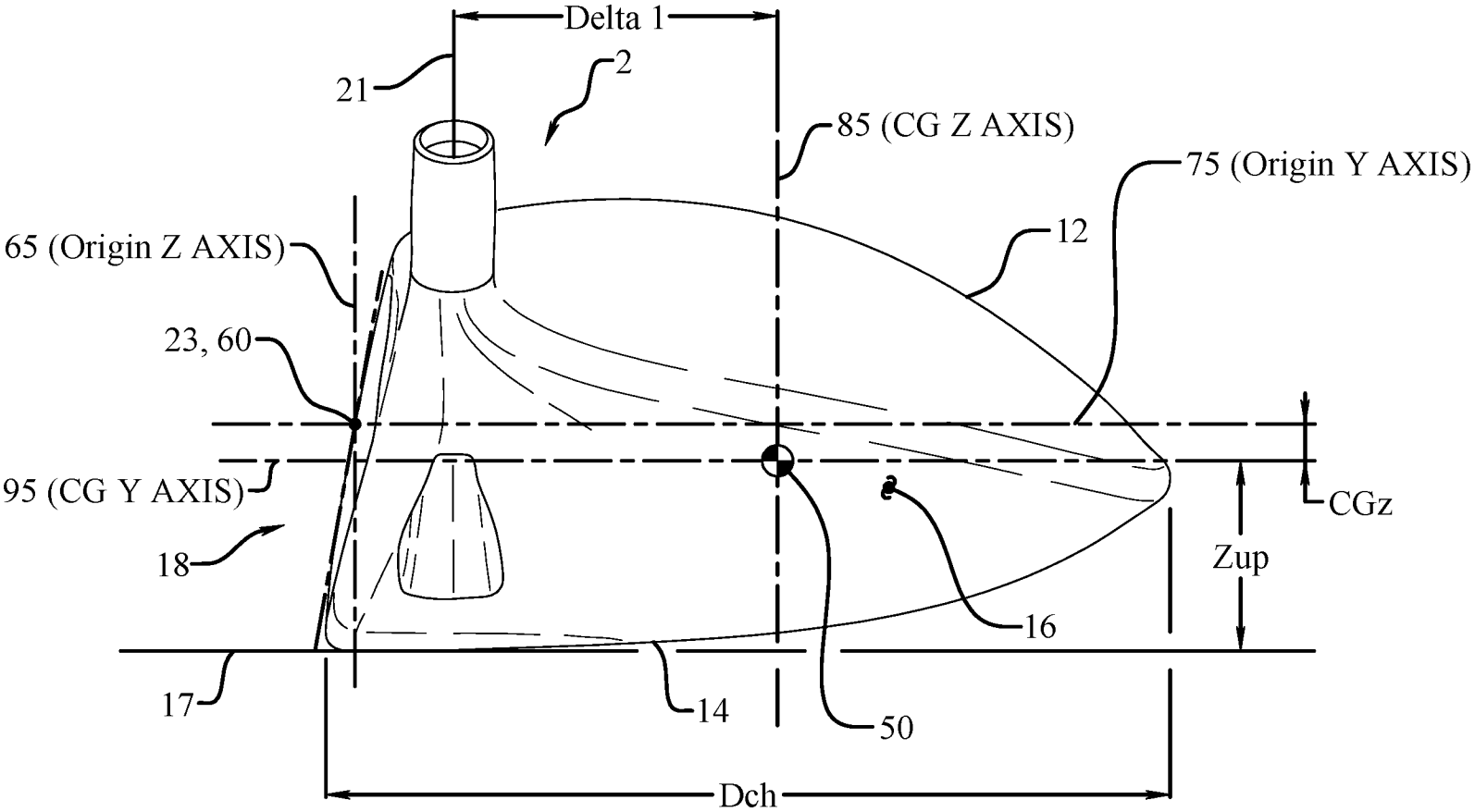
FIG. 7 is a side elevation view of an embodiment of an oversized golf club head.
Figure 8:
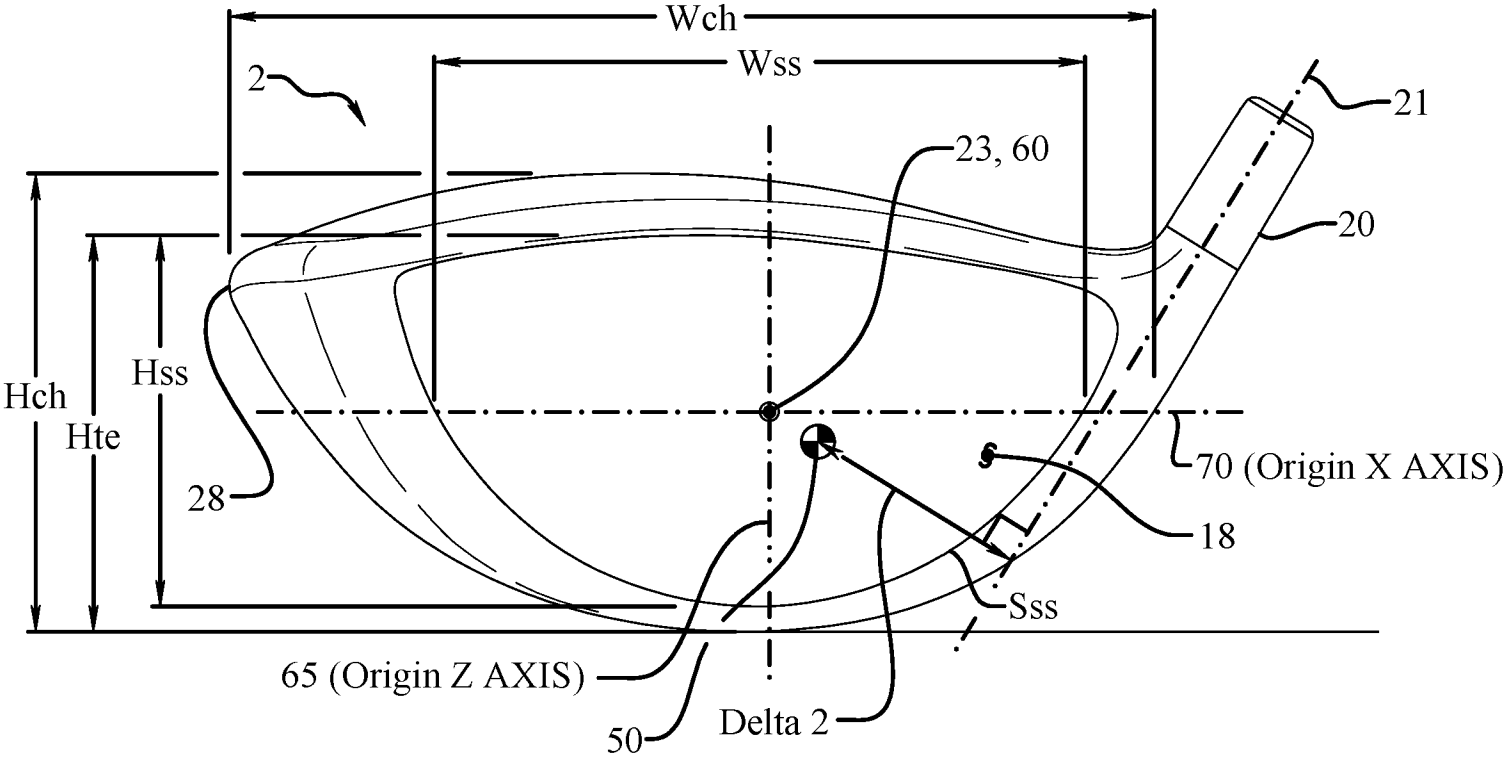
FIG. 8 is a front elevation view of an embodiment of an oversized golf club head.

Referring to FIGS. 7 and 8, the ideal impact location 23 of the golf club head 2 is disposed at the geometric center of the face 18. The ideal impact location 23 is typically defined as the intersection of the midpoints of a height Hss and a width Wss of the face 18. Both Hss and Wss are determined using the striking face curve Sss. The striking face curve is bounded on its periphery by all points where the face transitions from a substantially uniform bulge radius (face heel-to-toe radius of curvature) and a substantially uniform roll radius (face crown-to-sole radius of curvature) to the body. In the illustrated example, Hss is the distance from the periphery proximate to the sole portion of Sss to the periphery proximate to the crown portion of Sss measured in a vertical plane (perpendicular to ground) that extends through the geometric center of the face 18 (e.g., this plane is substantially normal to the x-axis). Further, as seen in FIG. 8, the face 18 has a top edge elevation, Hte, measured from the ground plane. Similarly, Wss is the distance from the periphery proximate to the heel portion of Sss to the periphery proximate to the toe portion of Sss measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. Additional specific implementations having additional specific values for face height Hss, face width Wss, and total striking surface area are described elsewhere herein.

In some embodiments, the striking face 18 is made of a composite material such as described in U.S. patent application Ser. Nos. 14/210,000, 14/154,513, 14/620,079, 14/184,585, and U.S. Pat. No. 9,174,099, and others disclosed herein, which are incorporated herein by reference. In other embodiments, the striking face 18 is made from a metal alloy (e.g., an alloy of titanium, steel, aluminum, and/or magnesium), ceramic material, or a combination of composite, metal alloy, and/or ceramic materials. Examples of titanium alloys include alpha alloys including, but not limited to, Ti-5AL-2SN-ELI, Ti-8AL-1MO-1V, Ti-9AL-1MO-1V; near-alpha alloys including, but not limited to, Ti-6Al-2Sn-4Zr-2Mo, Ti-5Al-5Sn-2Zr-2Mo, 1MI 685, Ti 1100, Ti-8Al-1Mo-1V, Ti-9AL-1MO-1V; alpha and beta alloys including, but not limited to, Ti-6Al-4V, Ti-6Al-4V-ELI, Ti-6Al-6V-2Sn; and beta and near beta alloys including, but not limited to, Ti-10V-2Fe-3Al, Ti-13V-11Cr-3Al, Ti-8Mo-8V-2Fe-3Al, Beta C, Ti-15-3. Additional examples of titanium alloys include 3-2.5, 6-4, SP700, 15-3-3-3, 10-2-3, or other alpha/near alpha, alpha-beta, and beta/near beta titanium alloys. Examples of steel alloys include 304, 410, 450, or 455 stainless steel. In several specific embodiments, the golf club head includes a body 10 that is formed of a metal (e.g., titanium), a metal alloy (e.g., an alloy of titanium, an alloy of aluminum, and/or an alloy of magnesium), a composite material, such as a graphitic composite, a ceramic material, an injection molded material, such as those disclosed in U.S. patent application Ser. No. 14/717,864, which is incorporated herein by reference, or any combination thereof.

When at normal address position as seen in FIG. 3, the oversized club head 2 is disposed at a lie-angle 19 relative to the club shaft axis 21 and the club face 18 has a loft angle 15. The lie-angle 19 refers to the angle between the centerline axis 21 of the club shaft and the ground plane 17 at the normal address position. Referring to FIG. 2, loft-angle 15 refers to the angle between a tangent line to the club face 18 and a vector normal to the ground plane 29 at normal address position.

A club shaft and/or shaft sleeve is received within the hosel bore 24 and is aligned with the centerline axis 21. In some embodiments, a connection assembly is provided that allows the shaft to be easily disconnected from the oversized club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24.

In one embodiment the sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The lower portion of the sleeve defines a longitudinally extending, internally threaded opening adapted to receive a screw for securing the shaft assembly to the club head 2 when the sleeve is inserted into the hosel opening 24. The oversized club head 2 may include a shaft connection assembly as disclosed in U.S. patent application Ser. Nos. 14/876,694 and 14/587,573, which are incorporated herein by reference, and some embodiments are described later herein. In another embodiment, in lieu of the splines, the upper portion of the sleeve has at least one alignment feature, sometimes referred to as tangs, that cooperates with a corresponding feature, or features, along the exterior perimeter of the hosel entrance, which may include a notch, or notches, that extend all the way through the hosel sidewall or only partially into the interior, or exterior, of the hosel sidewall. In one particular embodiment a ferrule is integrally formed as part of the sleeve and at least two tangs extend from the ferrule to cooperate with at least two notches formed in the end of the hosel.

In another embodiment the connection assembly includes at least one external shim, or wedge member, that fits around, and cooperates with, a portion of the sleeve, outside of the club head, and cooperates with a portion of the hosel, thereby permitting a user to adjust the loft, lie, and/or face angle of the golf club head, either dependently or independently without requiring the user to remove the shaft completely from the hosel. In one embodiment the at least one external shim is a tubular adjustment piece having non-parallel upper and lower surfaces, which encircles a central portion of the shaft sleeve so that the upper surface cooperates with an upper end of the shaft sleeve to releasably fix the tubular adjustment piece to the shaft sleeve. A fastener secures the shaft sleeve to the club head and brings a portion of the at least one external shim into engagement with a portion of the club head, which in a further embodiment prevents rotation of the at least one external shim and by default the shaft sleeve. In an embodiment the shim is a cylindrical adjustment piece with an upper surface that is not parallel with its lower surface, such that it has an angle $\alpha$ and tilts the shaft sleeve when the shim is sandwiched between the upper portion of the shaft sleeve, or another shim, and the hosel. The shim may include a first plurality of teeth that are sized to mate with matching alignment features on the hosel, and a second plurality of teeth sized to mate with matching alignment features on another shim. In still a further embodiment the at least one external shim may be a portion of a hosel sleeve, whereby a portion of the hosel sleeve extends into the hosel and possesses a central bore for receiving the shaft sleeve, while the external shim portion remains external to the club head.

Golf Club Head Coordinates

Figure 6:
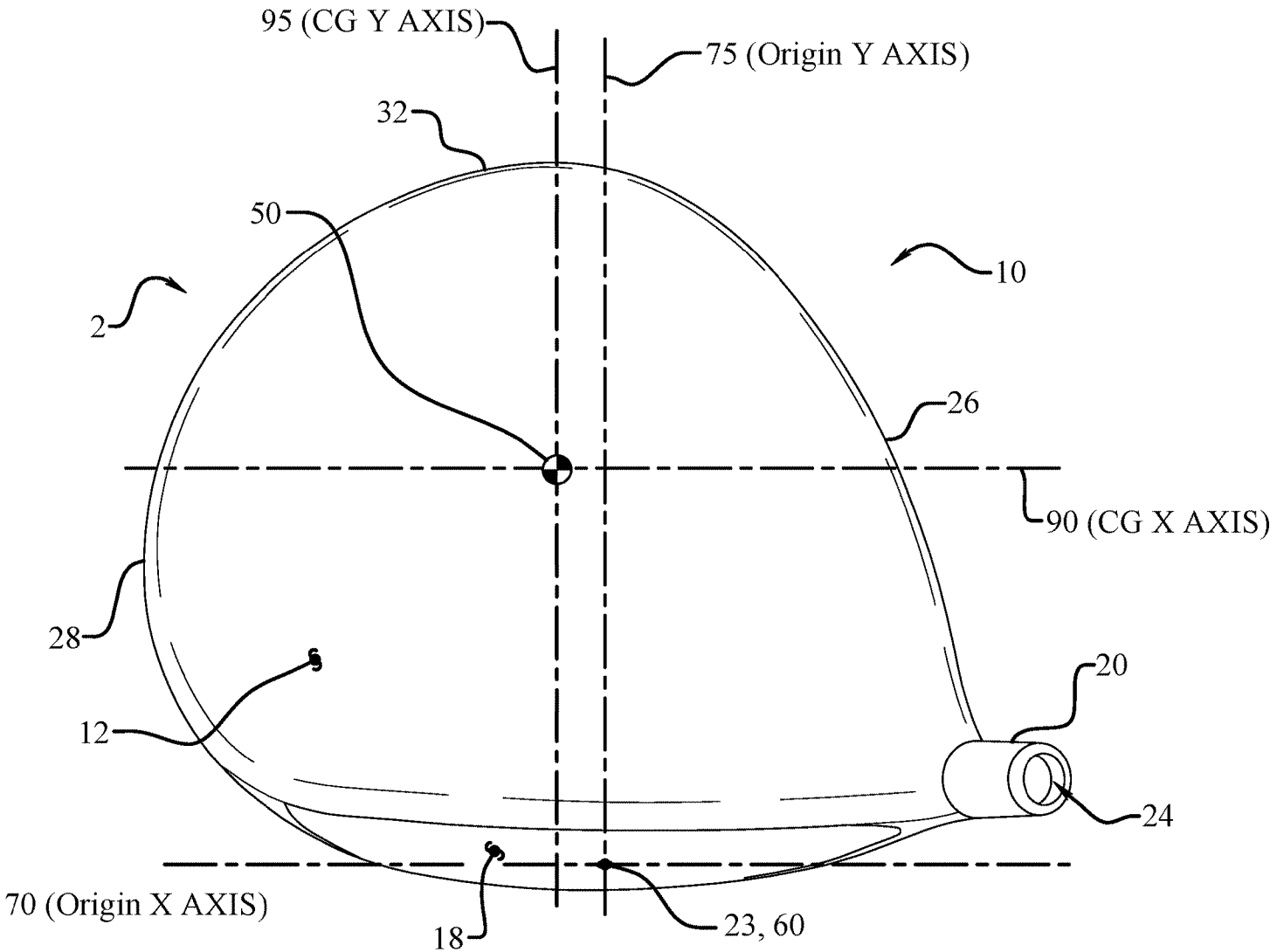
FIG. 6 is a top plan view of an embodiment of an oversized golf club head.

Referring to FIGS. 6-8, a club head origin coordinate system can be defined such that the location of various features of the oversized club head 2 including a club head center-of-gravity (CG) 50. A club head origin 60 is illustrated on the club head 2 positioned at the ideal impact location 23, or geometric center, of the face 18.

The head origin coordinate system defined with respect to the head origin 60 includes three axes: a z-axis 65, seen in FIG. 7, extending through the head origin 60 in a generally vertical direction relative to the ground 17 when the oversized club head 2 is at the normal address position; an x-axis 70, seen in FIG. 6, extending through the head origin 60 in a toe-to-heel direction generally parallel to the face 18, e.g., generally tangential to the face 18 at the ideal impact location 23, and generally perpendicular to the z-axis 65; and a y-axis 75, seen in FIG. 7, extending through the head origin 60 in a front-to-back direction and generally perpendicular to the x-axis 70 and to the z-axis 65. The x-axis 70 and the y-axis 75 both extend in generally horizontal directions relative to the ground 17 when the oversized club head 2 is at normal address position. The x-axis 70 extends in a positive direction from the origin 60 to the heel 26 of the oversized club head 2. The y-axis 75 extends in a positive direction from the origin 60 towards the rear portion 32 of the oversized club head 2. The z-axis 65 extends in a positive direction from the origin 60 towards the crown 12. Thus, if the oversized club head CG 50 is located 5 mm toward the heel from the head origin 60, and 5 mm below the head origin 60, and 25 mm behind the head origin 60, the head origin x-axis (CGx) coordinate would be 5 mm, the head origin y-axis (CGy) coordinate would be 25 mm, and the head origin z-axis (CGz) coordinate would be −5 mm.

An alternative, above ground, oversized club head coordinate system places the origin 60 at the intersection of the z-axis 65 and the ground plane 17, providing positive z-axis coordinates for every oversized club head feature. As used herein, "Zup" means the CG z-axis location determined according to the above ground coordinate system. Zup generally refers to the height of the CG 50 above the ground plane 17. Another alternative coordinate system uses the club head center-of-gravity (CG) 50 as the origin when the oversized club head 2 is at normal address position. Each center-of-gravity axis passes through the CG 50. For example, the CG x-axis 90, seen in FIG. 6, passes through the center-of-gravity 50 substantially parallel to the ground plane 17 and generally parallel to the origin x-axis 70 when the oversized club head 2 is at normal address position. Similarly, the CG y-axis 95 passes through the center-of-gravity 50 substantially parallel to the ground plane 17 and generally parallel to the origin y-axis 75, and the CG z-axis 85, seen in FIG. 7, passes through the center-of-gravity 50 substantially perpendicular to the ground plane 17 and generally parallel to the origin z-axis 65 when the oversized club head 2 is at normal address position.

Mass Moments of Inertia

Referring to FIGS. 6-7, oversized club head moments of inertia are typically defined about the three CG axes that extend through the golf club head center-of-gravity 50.

For example, a moment of inertia about the golf club head CG z-axis 85 can be calculated by the following equation:

$$Izz=\int(x^2+y^2)dm$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of an oversized golf club head to resist twisting about the CG z-axis. Greater moments of inertia about the CG z-axis (Izz) provide the oversized golf club head 2 with greater forgiveness on toe-ward or heel-ward off-center impacts with a golf ball. In other words, a golf ball hit by an oversized golf club head 2 on a location of the striking face 18 between the toe 28 and the ideal impact location 23 tends to cause the oversized golf club head 2 to twist rearwardly and the golf ball to draw (e.g., to have a curving trajectory from right-to-left for a right-handed swing). Similarly, a golf ball hit by an oversized golf club head 2 on a location of the striking face 18 between the heel 26 and the ideal impact location 23 causes the oversized golf club head 2 to twist forwardly and the golf ball to slice (e.g., to have a curving trajectory from left-to-right for a right-handed swing). Increasing the moment of inertia about the CG z-axis (Izz) reduces forward or rearward twisting of the oversized club head 2, reducing the negative effects of heel or toe mis-hits.

A moment of inertia about the golf club head CG x-axis 90 can be calculated by the following equation $$Ixx=\int(y^2+z^2)dm$$

where y is the distance from a golf club head CG xz-plane to an infinitesimal mass, dm, and z is the distance from a golf club head CG xy-plane to the infinitesimal mass, dm. The oversized club head CG xz-plane is a plane defined by the golf club head CG x-axis 90 and the oversized club head CG z-axis 85. The CG xy-plane is a plane defined by the golf club head CG x-axis 90 and the golf club head CG y-axis 95.

As the moment of inertia about the CG z-axis (Izz) is an indication of the ability of an oversized club head 2 to resist twisting about the CG z-axis, the moment of inertia about the CG x-axis (Ixx) is an indication of the ability of the oversized club head 2 to resist twisting about the CG x-axis. In general, greater moments of inertia about the CG x-axis (Ixx) improve the forgiveness of the oversized club head 2 on high and low off-center impacts with a golf ball. In other words, a golf ball hit by an oversized club head 2 on a location of the striking surface 18 above the ideal impact location 23 causes the oversized club head 2 to twist upwardly and the golf ball to have a higher trajectory than desired. Similarly, a golf ball hit by an oversized club head 2 on a location of the striking face 18 below the ideal impact location 23 causes the oversized club head 2 to twist downwardly and the golf ball to have a lower trajectory than desired. Increasing the moment of inertia about the CG x-axis (Ixx) reduces upward and downward twisting of the oversized club head 2, reducing the negative effects of high and low mis-hits.

A moment of inertia about the golf club head shaft axis 21 is referred to as the hosel axis moment of inertia (Ih) and is calculated in a similar manner and is an indication of the ability of the oversized club head 2 to resist twisting about the shaft axis 21, and also serves as a measure of the resistance a golfer senses during a golf swing as they attempt to bring the oversized club head 2 back to a square position to impact a golf ball.

Club Head Height, Width, and Depth

In addition to redistributing mass within a particular club head envelope as discussed immediately above, the club head center-of-gravity location 50 can also be tuned by modifying the oversized club head external envelope. Referring now to FIGS. 7 and 8, the oversized club head 2 has a maximum club head height Hch defined as the maximum above ground z-axis coordinate of the outer surface of the crown 12. Similarly, a maximum club head width Wch can be defined as the distance between the maximum extents of the heel and toe portions 26, 28 of the body measured along an axis parallel to the x-axis when the oversized club head 2 is at normal address position and a maximum club head depth Dch, or length, defined as the distance between the forwardmost and rearwardmost points on the surface of the body 10 measured along an axis parallel to the y-axis when the club head 2 is at normal address position. Generally, the height and width of oversized club head 2 should be measured according to the USGA "Procedure for Measuring the Clubhead Size of Wood Clubs" Revision 1.0. The heel portion 28 of the oversized club head 2 is broadly defined as the portion of the club head 2 from a vertical plane passing through the origin y-axis 75 toward the hosel 20, while the toe portion 26 is that portion of the oversized club head 2 on the opposite side of the vertical plane passing through the origin y-axis 75.

Oversized Golf Club Heads and Golf Clubs

Producing a playable oversized golf club head 2 is a difficult challenge that requires a lot of creativity and inventive steps in establishing performance enhancing design features and relationships, and oversized club head constructions that facilitate such features and relationships. In other words, simply scaling up a 400-460 cc club head, or using the conventional design practices associated with a 400-460 cc USGA conforming golf club head, is unlikely to produce an oversized club that appeals to the novice golfer, or provides the performance benefits a golfer would expect from an oversized golf club head 2. In fact, simply scaling up a 460 cc club head to 800 cc would produce a club head weighing over 265 grams, which is undesirably and would be plagued by detrimental mass properties.

In one embodiment the body 10 has a volume greater than 550 $cm^3$, or cc. In an even further embodiment the volume is at least 600 cc, while in a further embodiment the volume is at least 650 cc, and in even further embodiments the volume is at least 700 cc, at least 750 cc, and at least 800 cc. While such large volumes, combined with the other relationships disclosed herein, provide the golfer with increased confidence and offer performance benefits, as the size continues to increase the negatives start to outweigh the positives. At volumes above 950 cc the aerodynamic drag is significant and the ability of an average golfer to reliably control the opening and closing of the oversized club head 2 throughout the golf swing is diminished. Thus, in one embodiment the volume is no more than 950 cc, while in an even further embodiment it is less than 900 cc. A particularly effective series of embodiments has identified a synergistic balance of the pros and cons of oversized club heads 2 when the volume in the range of 650-900 cc, and in another embodiment the volume is 700-850 cc, while in an even further embodiment the volume is 750-825 cc.

It is important to note that while it may be easiest to characterize an oversized club head 2 as being oversized based upon the volume, in another embodiment the present oversized golf club head invention may be characterized as oversized due to large dimensions, yet still have a volume of 460 cc or less. Just as with volume, once the decision has been made to design an oversized club head 2, simply "scaling-up" a 430-460 cc conforming club head design is likely to result in an oversized club head 2 characterized by poor performance due to aerodynamics, mass properties, and/or club head construction. While the disclosed dimensions and volumes, combined with the other relationships disclosed herein, provide the golfer with increased confidence and offer performance benefits, as the dimensions continues to increase the negatives start to outweigh the positives. Again, uniquely discovered relationships concerning combinations of dimensions, mass properties, volume, and club head construction and materials provide the synergistic balance that is necessary to design a lightweight oversized club head 2 that is easy to use and offers improved performance. A club head depth Dch of greater than 175 mm was found to negatively impact a golfer's confidence and negatively influence performance, while having a club head depth Dch of less than 125 mm does not fully take advantage of the potential confidence and performance advantages afforded by an oversized club head 2. Thus, in one embodiment the club head depth Dch is at least 125 mm, while in another embodiment the club head depth Dch is at least 135 mm, and in yet a further embodiment the club head depth Dch is at least 145 mm. Further, in one embodiment the club head depth Dch is no more than 175 mm, while in another embodiment the club head depth Dch is no more than 165 mm, and in yet a further embodiment the club head depth Dch is less than 155 mm. Similarly, a club head height Hch of greater than 100 mm was found to negatively impact a golfer's confidence and negatively influence performance, while having a club head height Hch of less than 70 mm does not fully take advantage of the potential confidence and performance advantages afforded by an oversized club head 2. Thus, in one embodiment the club head height Hch is at least 70 mm, while in another embodiment the club head height Hch is at least 72.5 mm, in yet a further embodiment the club head height Hch is at least 75 mm, and in still another embodiment the club head height Hch is at least 80 mm. Further, in one embodiment the club head height Hch is no more than 100 mm, while in another embodiment the club head height Hch is no more than 90 mm, and in yet a further embodiment the club head height Hch is less than 80 mm. Additionally, a club head width Wch of greater than 170 mm was found to negatively impact a golfer's confidence and is difficult for a novice golfer to return to a square position at impact, while having a club head width Wch of less than 120 mm does not fully take advantage of the potential confidence and performance advantages afforded by an oversized club head 2. Thus, in one embodiment the club head width Wch is at least 120 mm, while in another embodiment the club head width Wch is at least 135 mm, and in yet a further embodiment the club head width Wch is at least 140 mm. Further, in one embodiment the club head width Wch is no more than 170 mm, while in another embodiment the club head width Wch is no more than 160 mm, and in yet a further embodiment the club head width Wch is less than 150 mm. In one particular embodiment the head depth (Dch) is greater than about 85% of the club head width (Wch).

Further, in another embodiment the present invention is characterized as oversized because it has a face area of at least 5000 $mm^2$, regardless of volume, club head depth Dch, or club head height Hch. In one particular embodiment the face area is at least 5250 $mm^2$, while in an even further embodiment the face area is at least 5500 $mm^2$, and in yet another embodiment the face area is at least 5750 $mm^2$. Again, uniquely discovered relationships concerning combinations of dimensions, mass properties, volume, and club head construction and materials provide the synergistic balance that is necessary to design a lightweight oversized club head 2 that is easy to use and offers improved performance. A face area of greater than 7000 $mm^2$ was found to negatively impact a golfer's confidence and negatively influence performance, while having a face area of less than 5000 $mm^2$ does not fully take advantage of the potential confidence and performance advantages afforded by a lightweight oversized club head. Thus, in one embodiment the face area is no more than 7000 $mm^2$, while in a further embodiment the face area is no more than 6500 $mm^2$, and in an even further embodiment the face area is no more than 6250 $mm^2$. The procedure for measuring the face area is disclosed in U.S. Pat. No. 8,096,897, which is incorporated by reference herein.

Further, a unique relationship of volume to face area has been discovered that produces a playable oversized club head 2 that is confidence inspiring, and not aesthetically jarring, while being easily controllable by a novice golfer, and providing them with the ability to return the club face 18 to a square position at impact with the golf ball without having to think about the fact that they are swinging an oversized club head 2, while yielding the performance benefits discussed herein. In one such embodiment a volume-to-face-area ratio of the volume to face area is at least 0.120 $cc/mm^2$, while in a further embodiment the volume-to-face-area ratio is at least 0.125 $cc/mm^2$, and in yet another embodiment the volume-to-face-area ratio is at least 0.140 $cc/mm^2$. In another embodiment the volume-to-face-area ratio is no more than 0.200 $cc/mm^2$, and in yet a further embodiment the volume-to-face-area ratio is no more than 0.170 $cc/mm^2$.

Similarly, a unique relationships of volume to face height Hss, and face width Wss, have been discovered that produces a playable oversized club head 2 that is confidence inspiring and aesthetically pleasing, while being easily controllable by a novice golfer, and providing them with the ability to return the club face 18 to a square position and more consistently impact with the golf ball near the ideal impact location 23, or geometric center, of the face 18 without having to think about the fact that they are swinging an oversized club head 2, while yielding the performance benefits discussed herein. In one such embodiment a volume-to-FH ratio of the volume to face height is at least 10 cc/mm, while in another embodiment the volume-to-FH ratio is at least 13 cc/mm. Additionally, a series of embodiments incorporate a preferred range of volume-to-FH ratios producing enhanced performance and reducing regions of diminishing, and negative, returns. For instance, in one such embodiment the volume-to-FH ratio is no more than 20 cc/mm, while in another embodiment the volume-to-FH ratio is no more than 15 cc/mm, and in yet a further embodiment the volume-to-FH ratio is 10.5-14 cc/mm. Now turning to face width embodiments, in one such embodiment the volume-to-FW ratio of the volume to the face width is at least 7 cc/mm, while in another embodiment the volume-to-FW ratio is at least 8 cc/mm. Additionally, a series of embodiments incorporate a preferred range of volume-to-FW ratios producing enhanced performance and reducing regions of diminishing, and negative, returns. For instance, in one such embodiment the volume-to-FW ratio is no more than 12 cc/mm, while in another embodiment the volume-to-FW ratio is no more than 9, and in yet a further embodiment the volume-to-FW ratio is 7.5-9 cc/mm.

In the past, oversized club heads 2 are often either (a) club heads that maintain a head weight close to a conforming club head, and therefore are generally less than 650 cc, as seen in Tables 1 and 2 below, or (b) club heads that give little regard to head weight, often in excess of 275 grams, in exchange for increasing the volume even further. A benefit of an oversized golf club 2 is the ability to increase the face area, thereby allowing novice golfers to produce a good shot even when the golf ball is struck a significant distance from the geometric center of the face, or ideal impact location 23. Another benefit of an oversized golf club 2 is the ability to increase the dimensions of the club head 2 to inspire confidence and improve forgiveness. However, taking advantage of these potential benefits while not adversely affecting the performance of the oversized club head 2, including but not limited to the aerodynamic performance as well as the associated golf ball launch conditions, which are heavily influenced by the mass properties and face attributes of the oversized club head 2, required the discovery of new relationships and ranges not commonly thought of during the design of conforming club heads.

The properties of two past oversized club heads are shown in Table 1 and Table 2 below, and nicely illustrate what happens when traditional design principles and constructions are applied to oversize club heads. In their chase to increase the size of the face of the club heads, while using conventional construction techniques, these club heads are exceedingly face heavy. In other words, as the face size has been increased, often in conjunction with increasing the face thickness to ensure the durability of such a large face, the center of gravity (CG) of the club head has moved exceedingly close to the face, as evidenced by CG angles of 11.9 degrees and 8.8 degrees, as well as Delta1 values of 8.9 mm and 5.7 mm. While in some designs a forward CG location may offer performance benefits, when taken to the extreme, as has been done with these two illustrative club heads due to conventional "scaling-up" thinking, the result is undesirable.

TABLE 1

| | Vol. (cc) | Weight (grams) | Face Height (mm) | Face Width (mm) | Bulge (mm) | Roll (mm) | Head Height (mm) | Head Depth (mm) |
|---|---|---|---|---|---|---|---|---|
| Head A | 634 | 201 | 66.7 | 100.6 | 247 | 247 | 74.7 | 114.6 |
| Head B | 609 | 202 | 66.4 | 92.6 | 243 | 243 | 74.8 | 113.5 |

TABLE 2

| | CGx mm | CGz mm | Zup mm | Delta 1 mm | Delta 2 mm | CG angle degrees | Ixx kg · mm$^2$ | Iyy kg · mm$^2$ | Izz kg · mm$^2$ | Ih kg · mm$^2$ |
|---|---|---|---|---|---|---|---|---|---|---|
| Head A | −0.9 | −0.4 | 37.3 | 8.9 | 41.9 | 11.9 | 295 | 380 | 506 | 879 |
| Head B | 0.9 | 2.3 | 39.9 | 5.7 | 37 | 8.8 | 286 | 270 | 505 | 744 |

Figure 10:
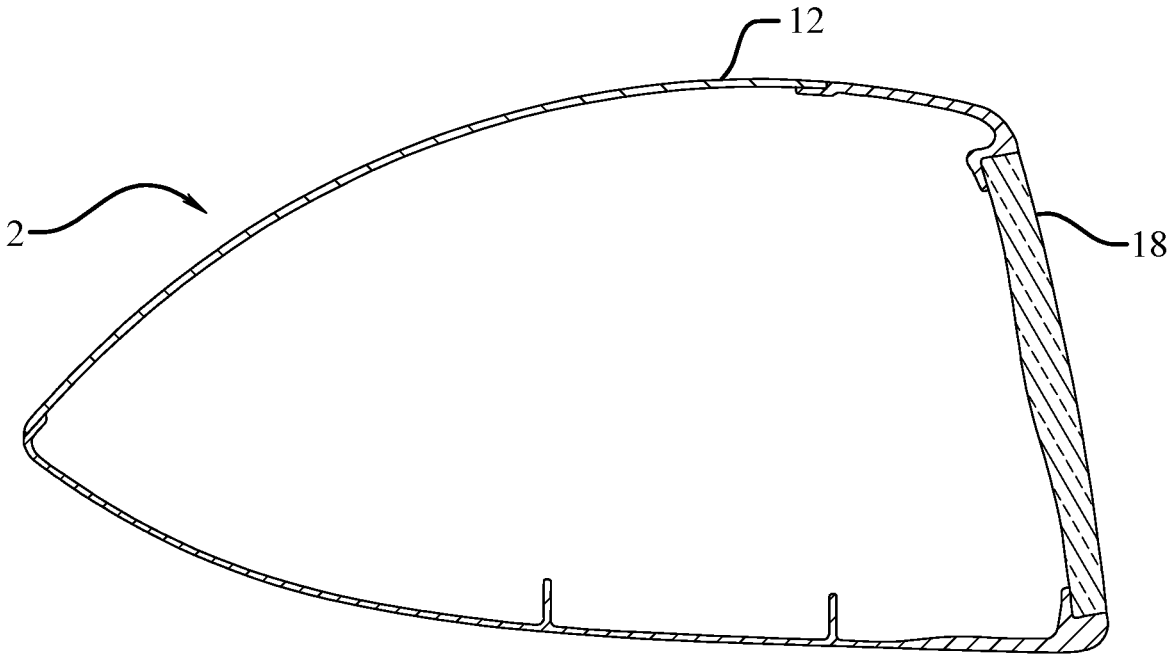
FIG. 10 is a cross-sectional view of an embodiment of an oversized golf club head taken along section line 10-10 in FIG. 1.

In one embodiment the present oversized club head 2 avoids such face heavy characteristics by incorporating a low-density material in at least a portion of the face 18, which may be metallic or non-metallic. As such, one particular embodiment has an average face density of less than 4 g/cc, while in another embodiment the average face density is less than 3 g/cc, and in yet another embodiment the average face density is less than 2 g/cc. In one particular embodiment, such as that seen in FIG. 10, at least 50% of the face area is composed of non-metallic material, such as that disclosed in U.S. patent application Ser. Nos. 14/210,000, 14/184,585, and 14/154,513, the entire contents of which are herein incorporated by reference. Such non-metallic materials may be on the outer, or striking side, of the face, or may be on the interior side of the face to provide support or reinforcing without actually coming in contact with the golf ball. In another embodiment at least 75% of the face area is composed of non-metallic material, while in an even further embodiment the entire face area is composed of non-metallic material, which provides roughly 5 grams of mass savings for every 500 mm$^2$ of face area, when compared to traditional titanium alloy face constructions. Therefore, an oversized club head 2 having a face area of 5500 mm$^2$ may save 20 grams by using an entirely non-metallic face 18, which then provides great flexibility in reallocating the location of this discretionary mass to beneficially control the mass properties of the oversized club head 2 and achieve one or more of the performance enhancing relationships disclosed herein, as well as increase the volume to levels not seen in oversized club heads 2 that maintain traditional head weights. This is particularly beneficial in lightweight oversized club heads 2 that traditionally lack the discretionary weight needed to effectively place the CG in a beneficial location. In another embodiment the oversized club head 2 has a face insert and face insert support, as seen in FIG. 10, such as that disclosed in U.S. patent application Ser. No. 14/699,905, the entire contents of which are herein incorporated by reference. In another embodiment the entire face insert is non-metallic and has a mass less than 60 grams, which in a further embodiment is less than 55 grams, and in yet another embodiment is less than 50 grams. Still further, in another embodiment the face 2 has a variable face thickness, such as that disclosed in U.S. patent application Ser. Nos. 14/565,311 and 14/456,927, the entire contents of which are herein incorporated by reference. In one particular embodiment the average face thickness is in the range of from about 1.0 mm to about 5.5 mm, while in another embodiment it is from about 1.5 mm to 5.0 mm, and in yet a further embodiment it is from about 2.0 mm to 4.5 mm.

In yet another embodiment the oversized club head 2 has a construction and characteristic time, or CT, profile as disclosed in U.S. patent application Ser. No. 14/862,438, the entire contents of which are herein incorporated by reference. In one particular embodiment the CT value at the ideal impact location is at least 280 microseconds, while in an even further embodiment it is at least 290 microseconds, and in yet another embodiment it is at least 300 microseconds. Additionally, in another embodiment the characteristic time at points along a horizontal axis through the ideal impact location 23, between a distance of 40 mm and −40 mm from the ideal impact location 23, deviate less than 20% from the characteristic time at the ideal impact location 23, while in a further embodiment the deviation is less than 15% from the characteristic time at the ideal impact location 23, and in yet another embodiment the deviation is less than 10% from the characteristic time at the ideal impact location 23.

The CG location is important in every club head, but even more so in oversized club heads 2. Traditionally the oversized nature of such a club head inspires confidence in a golfer, only to be disappointed by the associated performance because the oversized characteristics produce a CG location that is less than desirable, such as the exceedingly forward CG location, illustrated by the small CG angles and Delta1 values, and the high CG location (large Zup value) seen in Table 2. In some embodiments the CG location preferentially affects the Z-axis gear effect, which is particularly important in oversized club heads 2. For instance, in certain embodiments disclosed herein, the projected CG point on the ball striking club face 18 is located below the geometric center of the club face 18, or ideal impact point 23. A given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a low CG projection or a CG projection located at or near the ideal impact location on the striking face 18 improves the impact efficiency of the oversized golf club head 2 as well as initial ball speed. One important ball launch parameter, namely ball spin, is also improved. In some embodiments the projected CG point on the ball striking club face 18 is closer to the sole 14 than the geometric center. As a result, when the golf club is swung such that the club head 2 impacts a golf ball at the ideal impact point 23, the impact is "off center" from the projected CG point, creating torque that causes the body 10 of the golf club head 2 to rotate (or twist) about the CG x-axis. The rotation of the club face 18 creates a "z-axis gear effect." More specifically, the rotation of the club head 2 about the CG x-axis tends to induce a component of spin on the ball. In particular, the backward rotation of the face 18 that occurs as the golf ball is compressed against the face 18 during impact causes the ball to rotate in a direction opposite to the rotation of the face 18, much like two gears interfacing with one another. Thus, the backward rotation of the club face 18 during impact creates a component of forward rotation in the golf ball. This effect is termed the "z-axis gear effect." Because the loft 15 of a golf club head 2 also creates a significant amount of backspin in a ball impacted by the golf club head 2, the forward rotation resulting from the z-axis gear effect is typically not enough to completely eliminate the backspin of the golf ball, but instead reduces the backspin from that which would normally be experienced by the golf ball. In general, the forward rotation (or topspin) component resulting from the z-axis gear effect is increased as the impact point of a golf ball moves upward from (or higher above) the projected CG point on the ball striking club face 18, and having an oversized club head 2 and face 18 may promote strikes high on the face 18. Additionally, the effective loft of the golf club head 2 that is experienced by the golf ball and that determines the launch conditions of the golf ball can be different than the static loft 15 of the golf club head 2. The difference between the golf club head's effective loft at impact and its static loft angle 15 at address is referred to as "dynamic loft" and can result from a number of factors. In general, however, the effective loft of a golf club head is increased from the static loft 15 as the impact point of a golf ball moves upward from (or higher than) the projected CG point on the ball striking club face 18. Thus, an oversized club head 2 with a low CG, or relatively small Zup value, and associated low projected CG point has preferred z-axis gear effect particularly when combined with an increased face height Hss that tends to promote impacts higher on the face 18. In a further embodiment the static loft angle 15 is at 8-20 degrees, while in another embodiment it is 11-18 degrees, and in yet a further embodiment it is 13-16 degrees.

The trajectory of a golf ball hit by an oversized club head 2 having a projected CG that coincides with the geometric center of the striking surface, or ideal impact point 23, typically includes a low launch angle and a significant amount of backspin. The backspin on the ball causes it to quickly rise in altitude and obtain a more vertical trajectory, "ballooning" into the sky. Consequently, the ball tends to quickly lose its forward momentum as it is transferred to vertical momentum, eventually resulting in a steep downward trajectory that does not create a significant amount of roll. Even though some backspin can be beneficial to a golf ball's trajectory by allowing it to "rise" vertically and resist a parabolic trajectory, too much backspin can cause the golf ball to lose distance by transferring too much of its forward momentum into vertical momentum.

In contrast, the trajectory of a golf ball hit by an oversized club head 2 having a lower center of gravity has a higher launch angle and less backspin relative to the oversized club head 2 having a projected CG that coincides with the geometric center of the striking surface, and the trajectory includes less "ballooning" but still has enough backspin for the ball to have some rise and to generally maintain its launch trajectory longer than a ball with no backspin. As a result, the golf ball carries further because the horizontal momentum of the golf ball is greater, which also increases the roll-out upon landing.

As seen in FIG. 7, Delta1 is a measure of how far rearward in the club head body 10 the CG is located behind a vertical plane containing the shaft axis 21; and Zup is a measure of the vertical distance that the CG is located above the ground plane 17. Smaller values of Delta1 result in lower projected CGs on the club head face 18. Thus, for embodiments of the disclosed oversized golf club heads in which the projected CG on the ball striking club face 18 is lower than the geometric center, reducing Delta1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed oversized golf club heads, the Delta1 values are relatively low, thereby reducing the amount of backspin on the golf ball and helping the golf ball obtain the desired high launch, low spin trajectory.

Figure 9:
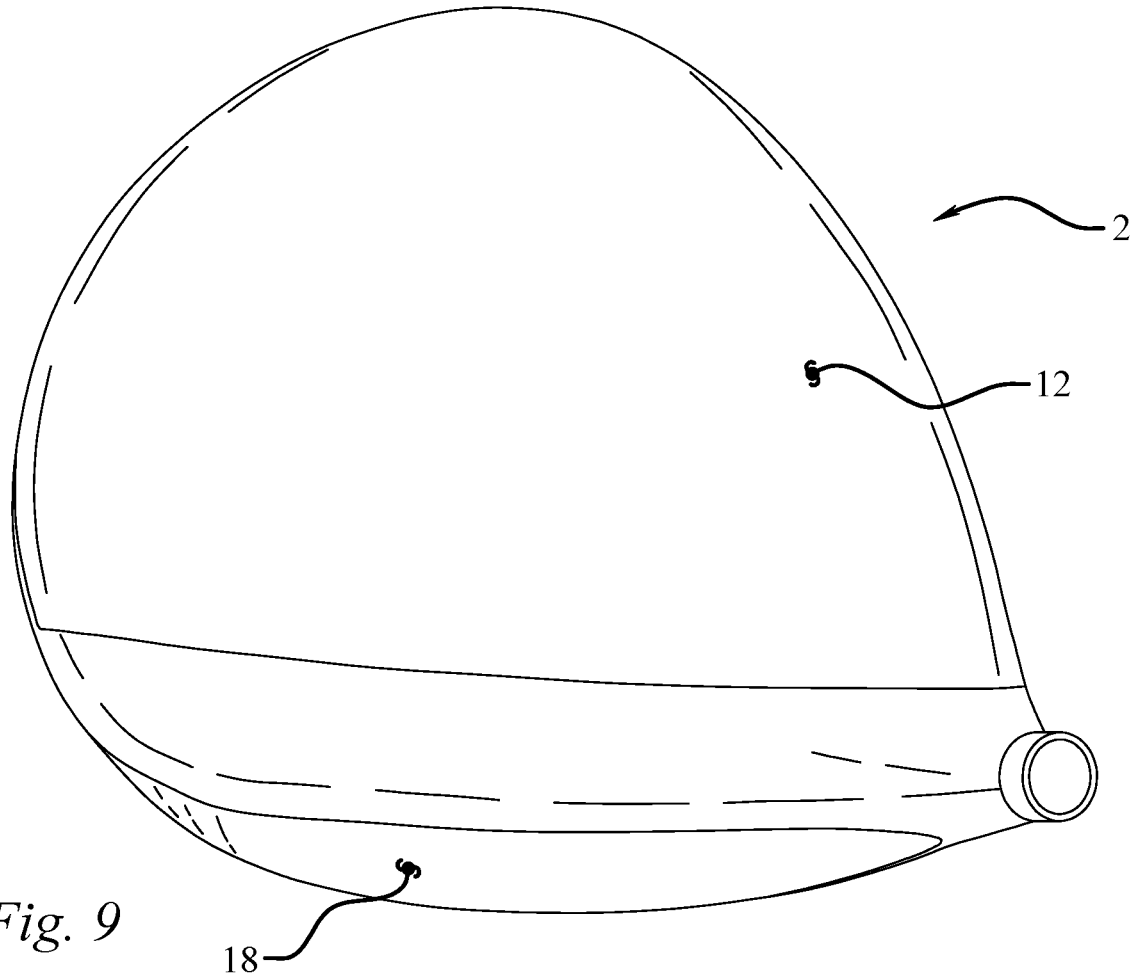
FIG. 9 is a top plan view of an embodiment of an oversized golf club head.

Adjusting the location of the discretionary mass in a golf club head 2, or the shape of the body 10 of the club head 2, can provide the desired Delta1 value. For instance, Delta1 can be manipulated by varying the mass in front of the CG (closer to the face) with respect to the mass behind the CG. That is, by increasing the mass behind the CG with respect to the mass in front of the CG, Delta1 can be increased. In a similar manner, by increasing the mass in front of the CG with the respect to the mass behind the CG, Delta1 can be decreased. The oversized club heads shown in Tables 1 and 2 suffer from a Delta1 value that is exceedingly small due to their use of metallic faces with large face areas, essentially making them face heavy. The shape of the body 10 may include any of the embodiments disclosed in U.S. patent application Ser. Nos. 14/325,168, 14/144,105, and 14/629,160, which are incorporated herein by reference. Additionally, one embodiment the present oversized club head 2 avoids the high CG location of the club heads shown in Tables 1 and 2 by incorporating a low-density material in at least a portion of the crown 12, which may be metallic or non-metallic. As such, one particular embodiment has an average crown density of less than 4 g/cc, while in another embodiment the average crown density is less than 3 g/cc, and in yet another embodiment the average crown density is less than 2 g/cc. In one particular embodiment, such as that seen in FIGS. 9 and 10, at least 50% of the crown area is composed of non-metallic material. In another embodiment at least 75% of the crown area is composed of non-metallic material. In another embodiment at least 50% of the surface area of the body 10 located above the height of the ideal impact location 23 is formed of non-metallic materials, while in an even further embodiment the non-metallic surface area located above the height of the ideal impact location 23 is at least 7500 $mm^2$, and in another embodiment the mass of the non-metallic portions located above the height of the ideal impact location 23 is 25-50 grams, while the mass is 30-45 grams in another embodiment, and is 15-25% of the total club head weight in still a further embodiment. In another embodiment at least 50% of the surface area of the body 10 located below the height of the ideal impact location 23 is formed of non-metallic materials, while in an even further embodiment the non-metallic surface area located below the height of the ideal impact location 23 is at least 7500 $mm^2$, and in another embodiment the mass of the non-metallic portions located below the height of the ideal impact location 23 is 15-50 grams, while the mass is 20-45 grams in another embodiment, and is 10-25% of the total club head weight in still a further embodiment. The non-metallic materials, body components, and construction techniques include, but are not limited to, all embodiments disclosed in U.S. patent application Ser. Nos. 14/516,503, 14/210,000, 14/184,585, 14/154,513, 14/717,864, 15/233,805, 15/087,002, and 62/205,601, the entire contents of which are herein incorporated by reference.

As previously mentioned, the Delta1 values of the oversized club heads in Tables 1 and 2 are not ideal. In one present embodiment, preferred z-axis gear effect and golf ball trajectory/launch characteristics are achieved in an oversize club head 2 when a volume-to-Delta1 ratio of the volume to the Delta1 value is no greater than 70 cc/mm, while in another embodiment the volume-to-Delta1 ratio is no greater than 65 cc/mm, while in an even further embodiment the volume-to-Delta1 ratio is no greater than 60 cc/mm, and in yet another embodiment the volume-to-Delta1 ratio is no greater than 55 cc/mm. A further series of embodiments identified preferred performance and feel when the volume-to-Delta1 ratio is maintained above 25 cc/mm, while in another embodiment it is at least 30 cc/mm, and in yet a further embodiment is at least 35 cc/mm, while in one embodiment a preferred range was identified as 40-65 cc/mm, and 45-60 cc/mm in still a further embodiment. Similarly, the Zup values of the oversized club heads of Tables 1 and 2 are not ideal. In one preferred z-axis gear effect and golf ball trajectory/launch characteristics are achieved in an oversize club head 2 when a volume-to-Zup ratio of the volume to the Zup value is at least 18 cc/mm, while in another embodiment the ratio is at least 20 cc/mm, in yet a further embodiment it is at least 22 cc/mm, and in still another embodiment it is at least 24 cc/mm. Another series of embodiments limits the top end of the volume-to-Zup ratio to provide the desired performance with the volume-to-Zup ratio not exceeding 30 cc/mm, while in another embodiment the ratio does not exceed 28 cc/mm, and in still a further embodiment the ratio does not exceed 26 cc/mm. Similarly, another series of embodiments have a Zup-to-Delta1 ratio that is 1.8-4, while in another embodiment the ratio is 2.0-3.5, and it is 2.2-3.0 in an even further embodiment. An even further series of embodiments a volume-to-Zup/Delta1 ratio of the volume to the Zup-to-Delta1 ratio that is at least 300 cc, while at least 320 cc in another embodiment, and at least 340 cc in yet a further embodiment; and further embodiments cap this ratio at no more than 400 cc in a first embodiment, no more than 380 cc in a second embodiment, and no more than 360 cc in a third embodiment. Ratios outside of these ranges unexpectedly produced a feeling in instability at impact, particularly on mis-hits, and may be more difficult to return to a square position at impact with the golf ball. In another embodiment preferred z-axis gear effect and trajectory are achieved in an oversize club head 2, when the Delta1 value is at least 9% of the head depth Dch, while in another embodiment the Delta1 value is no more than 14% of the head depth Dch, while in an even further embodiment the Delta1 value is 10-13% of the head depth Dch. In an even further embodiment preferred z-axis gear effect and trajectory are achieved in an oversize club head 2 when the Delta1 value is at least 10 mm, while in a further embodiment the Delta1 value is no more than 20 mm, while in yet a further embodiment the Delta1 value is no more than 18 mm, and in still a further embodiment the Delta1 value is no more than 16 mm.

As seen in FIG. 8, a Delta2 value is another important dimension used in quantifying the location of the center of gravity 50, which also influences the performance of the oversized club head 2. First, create an imaginary vertical shaft axis plane containing the shaft axis 21. Next, project the center of gravity 50 forward, along the CG y axis 95, seen in FIG. 6, until it strikes the imaginary vertical shaft axis plane thereby defining a point referred to as the D2 point. The shortest distance from the D2 point to the shaft axis 21 is the Delta2 value, thus the Delta2 value is the distance from the D2 point to a shaft-axis-intersection point within the imaginary vertical shaft axis plane. Therefore, an imaginary triangle may be created starting at the center of gravity 50 with a first leg along the CG y axis 95 with a magnitude of the Delta1 value; a second leg within the imaginary vertical shaft axis plane extends from the D2 point to the shaft-axis-intersection point, and has a magnitude of the Delta2 value; and the hypotenuse of the triangle extends from the shaft-axis-intersection point to the center of gravity 50. The CG angle is the angle between the second leg and the hypotenuse. Therefore, the tangent of the CG angle is equal to the D1 value divided by the D2 value, allowing for easy calculation of the CG angle.

As mentioned throughout, simply scaling up a conventional 430-460 cc conforming club head to create an oversized club head will not provide the performance or playability that a novice golfer needs or expects from an oversized club head 2. Tables 1 and 2 illustrate prior oversized club heads that fail to appreciate and achieve the unique relationships necessary to afford the desire performance, while not creating a club head that is difficult for a novice golfer to maneuver and return to a square position. Such surprising and unique relationships include variations of Delta1, Delta2, CG angle, moments of inertia, volume, face dimensions, bulge, roll, and club head dimensions, as well as unique and unexpected ratios of such variables that box in unexpected characteristics to achieve the goals disclosed herein.

As previously touched upon, as the face size has been increased, often in conjunction with increasing the face thickness to ensure the durability of such a large face, the center of gravity (CG) of the club head has moved exceedingly close to the face, as evidenced by CG angles of 11.9 degrees and 8.8 degrees, as well as Delta1 values of 8.9 mm and 5.7 mm, seen in the club heads of Tables 1 and 2. While in some designs a forward CG location may offer performance benefits, when taken to the extreme, as has been done with these two illustrative club heads due to conventional "scaling-up" thinking, the result is undesirable and are characterized by moments of inertia that are too small for the size of the club head resulting in a feeling of club head instability when a golf ball is stuck a significant distance from the geometric center of the face 18. Therefore, in one embodiment of the present invention the CG angle is at least 14 degrees, while in a further embodiment the CG angle is at least 16 degrees. Further, in another series of embodiments the CG angle is no more than 34 degrees, while in a further embodiment it is no more than 30 degrees, and in yet another embodiment the CG angle is no more than 26 degrees, and in an even further embodiment the CG angle is no more than 22 degrees. In one particular embodiment the CG angle is 14-18 degrees.

Obviously the Delta2 value is going to increase in an oversized club head 2 compared to a conforming 430-460 cc club head, however preferential performance of the present oversized club head 2 was unexpectedly found when the CG angle was relatively consistent with that of a conventional conforming club head despite the increases in volume, club head dimensions, and/or face area. In one particular embodiment the Delta2 value is at least 38 mm, while in another embodiment the Delta2 value is at least 40 mm, and in yet an even further embodiment the Delta2 value is at least 42 mm. Another series of embodiments recognizes the limits of Delta2 values that promote the goals, thus in one embodiment the Delta2 value is no more than 54 mm, while in another embodiment it is no more than 50 mm, and in yet another embodiment the Delta2 value is no more than 46 mm. In another embodiment preferred playability and ease of returning the club head to square are achieved in an oversize club head 2 when the Delta2 value is no more than 31% of the head depth Dch, and no more than 30% in another embodiment, and no more than 29% in an even further embodiment. However, the objectives are further enhanced in a series of embodiments in which the Delta2 value is at least 24% of the head depth Dch, and at least 26% in a further embodiment, and at least 28% in an even further embodiment. These objectives are also achieved in an embodiment in which a volume-to-Delta2 ratio of the volume to the Delta2 value is at least 17 cc/mm, which in another embodiment is at least 18 cc/mm, and in yet another embodiment is at least 19 cc/mm. Further, another embodiment recognizes the diminishing returns of the volume-to-Delta2 ratio and has a volume-to-Delta2 ratio of 17-23 cc/mm, while in a further embodiment the ratio is 18-22 cc/mm, and in an even further embodiment the ratio is 19-21 cc/mm. Further, another embodiment that unexpectedly achieves the desired objectives is characterized by a Delta ratio of Delta2 to Delta1 that is no more than 4.5, while in another embodiment the Delta ratio is no more than 4.0, and in yet a further embodiment the Delta ratio is no more than 3.5, while in yet another embodiment the Delta ratio is no more than 3.0. Another series of embodiments recognize a preferential floor of the Delta ratio whereby the Delta ratio is at least 1.5, while in a further embodiment the Delta ratio is at least 2.0, and in yet another embodiment the Delta ratio is at least 2.5. In yet another embodiment, preferred performance is achieve when the elevation of the shaft-axis-intersection point, above the ground plane 17, is greater than zero and no more than 12.5 mm, while in a further embodiment it is 2.5-10 mm, and in yet another embodiment it is 5-10 mm.

Similarly, another embodiment exhibiting preferential performance was unexpectedly found when a depth-to-Zup ratio of the head depth Dch to the Zup value was relatively consistent with that of a conventional conforming club head despite the increases in volume, club head dimensions, and/or face area. In one such embodiment the depth-to-Zup ratio is at least 3.50, while in another embodiment it is at least 3.75, at least 4.00 in a further embodiment, and at least 4.25 in an even further embodiment. In one particularly effective embodiment has a depth-to-Zup ratio of 3.50-5.25, while the range is 3.75-5.00 in another embodiment, 4.00-4.75 in still another embodiment, and 4.25-4.50 in yet a further embodiment.

Even further, it was determined that an unexpected ratio of the hosel axis moment of inertia (Ih) to the Delta1 value, referred to as the hosel axis ratio, is a good indicator of the feel and difficulty a novice golfer is going to have controlling the oversized club head 2 throughout the swing, while avoiding the previously explained unstable feeling associated with mis-hits struck far from the geometric center of the face 18. In one such embodiment the hosel axis ratio is no more than 90 kg·mm, while in a further embodiment the hosel axis ratio is no more than 80 kg·mm, and in yet another embodiment the hosel axis ratio is no more than 70 kg·mm, and in an even further embodiment the hosel axis ratio is no more than 65 kg·mm. Another series of embodiments recognize a preferential floor of the hosel axis ratio whereby it is at least 40 kg·mm, while in another embodiment it is at least 50 kg·mm, and in yet another embodiment it is at least 55 kg·mm, while in still a further embodiment it is at least 57.5 kg·mm. In one particular embodiment the hosel axis moment of inertia (Ih) is at least 900 $kg \cdot mm^2$, while in another embodiment it is at least 920 $kg \cdot mm^2$, while in yet another embodiment it is no more than 1050 $kg \cdot mm^2$, and in an even further embodiment it is no more than 1000 $kg \cdot mm^2$. Likewise, in another preferred series of embodiments an Ih-to-Zup ratio of the hosel axis moment of inertia (Ih) to the Zup value is at least 25 kg·mm, while in a further embodiment it is at least 26 kg·mm, and in yet another embodiment it is at least 27 kg·mm. In an even further series of embodiments the Ih-to-Zup ratio is no more than 35 kg·mm, while in another embodiment it is no more than 32 kg·mm, and in yet a further embodiment it is no more than 29 kg·mm. The disclosed ratios and ranges unexpectedly produce preferred launch conditions while not sacrificing playability and feel of the oversized golf club in the hands of a novice golfer.

An extreme forward CG location in an oversized club head 2 often results in a feeling of club head instability upon mis-hits struck far from the ideal impact point 23, due in part to moments of inertia that are too small for the size of the club head. While a degree of club head twisting is sensed by a novice golfer using a conforming golf club head when a golf ball is struck at the extreme toe or heel portion of the face, it is significantly more noticeable when using an oversized club head 2, particularly one shots struck high on the face or low on the face, which is virtually unperceivable to a novice golfer using a non-oversized club head. As such, another family of embodiments reduce this feeling with additional volumetric ratios created with reference to one or more of the other moment of inertial values, specifically Izz, Iyy, Ixx, and Ih. In one such embodiment a volume-to-Ixx ratio of the volume to the Ixx value is at least 2.1 cc/($kg \cdot mm^2$), whereas in a further embodiment the ratio is at least 2.25 cc/($kg \cdot mm^2$). Additional embodiments introduce limits to the upper extreme of this ratio to limit diminishing returns such as one particular embodiment in which the volume-to-Ixx ratio is no more than 3.0 cc/(kg·mm$^2$), and in an even further embodiment the ratio is no more than 2.75 cc/(kg·mm$^2$). In another such embodiment a volume-to-Izz ratio of the volume to the Izz value is at least 1.3 cc/(kg·mm$^2$), whereas in a further embodiment the ratio is at least 1.5 cc/(kg·mm$^2$). Additional embodiments introduce limits to the upper extreme of this ratio to limit diminishing returns such as one particular embodiment in which the volume-to-Izz ratio is no more than 2.1 cc/(kg·mm$^2$), and in an even further embodiment the ratio is no more than 1.9 cc/(kg·mm$^2$). Still further, in another such embodiment a volume-to-Ih ratio of the volume to the Ih value is at least 0.8 cc/(kg·mm$^2$), whereas in a further embodiment the ratio is at least 0.9 cc/(kg·mm$^2$). Additional embodiments introduce limits to the upper extreme of this ratio to limit diminishing returns such as one particular embodiment in which the volume-to-Ih ratio is no more than 1.2 cc/(kg·mm$^2$), and in an even further embodiment the ratio is no more than 1.0 cc/(kg·mm$^2$). Still even further, in another such embodiment a volume-to-Iyy ratio of the volume to the Iyy value is at least 1.7 cc/(kg·mm$^2$), whereas in a further embodiment the ratio is at least 1.9 cc/(kg·mm$^2$). Additional embodiments introduce limits to the upper extreme of this ratio to limit diminishing returns such as one particular embodiment in which the volume-to-Iyy ratio is no more than 2.5 cc/(kg·mm$^2$), and in an even further embodiment the ratio is no more than 2.25 cc/(kg·mm$^2$).

In one particular embodiment the Ixx value is at least 300 kg·mm$^2$, while in a further embodiment the Ixx value is at least 320 kg·mm$^2$, and in yet another embodiment the Ixx value is at least 340 kg·mm$^2$. Another series of embodiments introduces new limits on the Ixx value range to ensure the desired z-axis gear effect is not reduces or negated. For instance, in one embodiment the Ixx value is no more than 425 kg·mm$^2$, while in another embodiment the Ixx value is no more than 400 kg·mm$^2$, and in yet an even further embodiment the Ixx value is no more than 375 kg·mm$^2$. In another particular embodiment Iyy value is at least 400 kg·mm$^2$, while in a further embodiment the Iyy value is at least 425 kg·mm$^2$, and in yet another embodiment the Iyy value is at least 425 kg·mm$^2$. Another series of embodiments introduces new limits on the Iyy value range to promote a natural feeling when the oversized club head 2 is moved throughout the range of motion of a golf swing by a novice golfer. For instance, in one embodiment the Iyy value is no more than 525 kg·mm$^2$, while in another embodiment the Iyy value is no more than 500 kg·mm$^2$, and in yet another embodiment the Iyy value is no more than 475 kg·mm$^2$. In another particular embodiment the Izz value is at least 525 kg·mm$^2$ thereby reducing the feeling of the oversized club head 2 spinning open or closed when mis-hits are struck on the extreme toe or heel size of the oversized face 18, while in a further embodiment the Izz value is at least 550 kg·mm$^2$, and in yet another embodiment the Izz value is at least 575 kg·mm$^2$. Another series of embodiments introduces new limits on the Izz value range so that a novice golfer does not feel as though they need to introduce additional rotation of their hands and the grip to square the face 18 at impact with the golf ball. For instance, in one embodiment the Izz value is no more than 700 kg·mm$^2$, while in another embodiment the Izz value is no more than 650 kg·mm$^2$, and in yet another embodiment the Izz value is no more than 625 kg·mm$^2$. In still a further embodiment preferential feel and performance is found when the Izz value is between about 450 kg·mm$^2$ and about 650 kg·mm$^2$. Still further embodiments of the oversized club head 2 may incorporate any of the ratios and relationships disclosed in U.S. patent application Ser. No. 14/177,094, which is incorporated by reference herein.

Additionally, the location of the CG 50 may be used to further the goal of assisting the novice golfer maneuver the oversized club head 2 throughout the swing and promote the return to the square position at impact with the golf ball. In one such example the CGx value greater than −2.0 mm, while in a further embodiment it is at least 1 mm, while in yet a further embodiment it is at least 3 mm, and in an even further embodiment it is at least 5 mm. However, too much heel biasing of the CG location may negatively influence performance, and may be more perceivable as the Delta2 value increases, therefore in another embodiment the CGx value is no more than 10 mm, while in a further embodiment it is no more than 8 mm, and in yet a further embodiment it is no more than 6 mm. As previously explained, Delta1 is a measure of how far rearward in the club head body 10 the CG is located behind a vertical plane containing the shaft axis 21, further a center face progression CFP is a measure of how far the geometric face center, or ideal impact location 23, is in front of the vertical plane containing the shaft axis 21, and the CGy value is the sum of Delta1 and CFP. As noted with several other variables, the "scaling-up" approach in creating an oversized club head produces an oversized club head that suffers from many deficiencies. Another such deficiency is a large CFP-Delta1 ratio, which is a ratio of the CFP to the Delta1 value, and again, like many of the ratios disclosed herein, is not something ordinarily considered when designing a conforming club head but has been found to contribute to the feel and performance of oversized club heads 2. Therefore, in one such embodiment the CFP-Delta1 ratio is no more than 2.25, while in another embodiment it is no more than 2.00, and no more than 1.75 in yet another embodiment, and no more than 1.50 in an even further embodiment. In another series of embodiments a preferred lower limit of the CFP-Delta1 ratio has been discovered for oversized club heads 2, which in one embodiment is at least 1.00, and is at least 1.25 in a further embodiment. The CFP influences the mass properties of the oversized golf club head 2, but also must achieve a delicate balance with the mass properties to achieve an oversized club head 2 that is easy to control. In one particular embodiment the CGy value is at least 25 mm, while in a further embodiment it is at least 30 mm, while in yet an even further embodiment it is at least 32 mm, and in still another embodiment it is at least 34 mm. In another series of embodiments the CGy value is no more than 50 mm in one embodiment, while being no more than 40 mm in another embodiment, no more than 38 mm in another embodiment, and no more than 36 mm in yet another embodiment. In another embodiment the CGz value is no more than 0 mm, while in a further embodiment the CGz value is no more than −2.0 mm, in yet another embodiment it is no more than −4.0 mm, and in an even further embodiment it is no more than −6.0. Another series of embodiments balances how low a projected CG point should be in an oversized club head 2 having a tall face height Hss by ensuring the CGz value is no less than −24 mm, while in a further embodiment it is no less than −20.0 mm, in yet a further embodiment it is no less than −16.0 mm, and in still another embodiment it is no less than −12.0 mm. Conventional oversized club heads have struggled to obtain GCz values of 0 or less. In yet another embodiment the oversized golf club head 2 may include any of the ratios, products, relationships, and/or embodiments found in U.S. patent application Ser. Nos. 13/789,441, 13/839,727, and 15/146,581, which are incorporated by reference herein. In another embodiment the Zup value is no more than 35 mm, while in a further embodiment it is no more than 33 mm, and in yet a further embodiment it is no more than 30 mm. A further series of embodiments tailor the Zup value to achieve a desired z-axis gear effect by establishing a floor to the Zup range, with one embodiment having a Zup of at least 10 mm, while another embodiment has a Zup of at least 15 mm, and yet another embodiment has a Zup of at least 20 mm. In one particular embodiment having preferred launch characteristics has an elevation of the shaft-axis-intersection point above the ground plane 17 that is greater than zero and no more than 12.5 mm.

An example of an embodiment of the oversized club head 2 is seen in Tables 3 and 4 below.

TABLE 3

| | Vol. (cc) | Weight (grams) | Face Height (mm) | Face Width (mm) | Bulge (mm) | Roll (mm) | Head Height (mm) | Head Depth (mm) |
|---|---|---|---|---|---|---|---|---|
| Example 1 | 802 | 202.5 | 65.7 | 98.6 | 368 | 368 | 75.8 | 142.1 |

TABLE 4

| | CGx mm | CGz mm | Zup mm | Delta 1 mm | Delta 2 mm | CG angle deg's | Ixx kg · mm$^2$ | Iyy kg · mm$^2$ | Izz kg · mm$^2$ | Ih kg · mm$^2$ |
|---|---|---|---|---|---|---|---|---|---|---|
| Example 1 | 3.5 | −2.7 | 33.3 | 14.9 | 42.1 | 19.4 | 346 | 459 | 591 | 921 |

Another important influencer of z-axis gear effect is the curvature of the face 18. Bulge and roll are golf club face 18 properties that are generally used to compensate for gear effect. The term "bulge" on a golf club head 2 refers to the rounded properties of the golf club face 18 from the heel 26 to the toe 28 of the club face 18. The term "roll" on a golf club head 2 refers to the rounded properties of the golf club face 18 from the crown 12 to the sole 14 of the club face 18. The roll radius R refers to the radius of a circle having an arc that corresponds to the arc along the z-axis of the ball striking club face 18. Curvature is the inverse of radius and is defined as 1/R, where R is the radius of the circle having an arc corresponding to the arc along the z-axis of the ball striking club face 18. As an example, a roll with a curvature of 0.0050 mm$^{-1}$ corresponds to a roll with a radius of 200 mm. The process for measure bulge and roll is disclosed later herein.

The roll of the oversized golf club head 2 can contribute to the amount of backspin that the golf ball acquires when it is struck by the oversized club head 2 at a point on the club face 18 either above or below the projected CG of the oversized club head 2. For example, shots struck at a point on the club face 18 above the projected CG have less backspin than shots struck at or below the projected CG. If the roll radius of the oversized club head 2 is decreased, there will be a decreased variance between backspin for shots struck above the projected CG of the golf club face 18 and shots struck below the projected CG of the ball striking club face 18. In certain embodiments of the disclosed oversized golf club heads 2, the roll radius is relatively large (e.g., greater than or equal to 300 mm). Thus, for embodiments of the disclosed oversized golf club heads 2 in which the projected CG on the ball striking club face is lower than the geometric center 23, the higher roll radius operates to enhance the z-axis gear effect when a ball is struck at the geometric center, thereby reducing the amount of backspin on the golf ball and helping the golf ball obtain the desired high launch, low spin trajectory.

Taking advantage of the roll to influence z-axis gear effect is particularly important in oversize club heads 2 having large head heights, Hch, and face heights, Hss. One such embodiment has a roll-to-FH ratio of the roll (mm) to the face height Hss (mm) of at least 5.0, thereby promoting preferred z-axis gear effect, launch conditions, and trajectory. In a further embodiment the roll-to-FH ratio is at least 5.25, while in an even further embodiment it is at least 5.5. Another series of embodiments discovers that an upper limit of this roll-to-FH ratio promotes preferred z-axis gear effect, launch conditions, and trajectory associated with oversized club heads 2 having large face heights Hss. For instance, in one embodiment the roll-to-FH ratio is no more than 6.5, while in another embodiment the roll-to-FH ratio is no more than 6.25, and in yet a further embodiment the roll-to-FH ratio is no more than 6.0. Prior oversized club heads, as seen in Table 1, often have a roll similar to that of conforming club heads having a volume of 460 cc or less, which can be visually distracting to a golfer when applied to an oversized club head 2 and result in poor performance due to excessive spin and poor trajectory. In fact, this ratio for the club heads of Table 1 is less than 3.75.

Those in the golf industry are more accustomed to thinking of gear effect as being associated with the bulge and imparting corrective spin to a golf ball. Again, just as will roll, applying conventional bulge curvature to an oversized club head 2 having a large face width, Wss, will likely be perceived as unappealing to the eye, and negatively impact performance. Thus, in some embodiments the bulge is tailored to control such corrective spin and ensure that too much corrective spin is not imparted to the ball in association with off-center impacts. One such embodiment has a bulge-to-FW ratio of the bulge (mm) to the face width Wss (mm) of at least 3.4, thereby promoting preferred gear effect, launch conditions, and corrective spin. In a further embodiment the bulge-to-FW ratio is at least 3.5, while in an even further embodiment it is at least 3.6. Another series of embodiments discovers that an upper limit of this bulge-to-FW ratio promotes preferred gear effect, launch conditions, and corrective spin associated with oversized club heads 2 having large face widths, Wss. For instance, in one embodiment the bulge-to-FW ratio is no more than 6.0, while in another embodiment the bulge-to-FW ratio is no more than 5.0, and in yet a further embodiment the bulge-to-FW ratio is no more than 4.25. Prior oversized club heads, as seen in Table 1, often have a bulge similar to that of conforming club heads having a volume of 460 cc or less, which can be distracting to a golfer when applied to an oversized club head 2 and result in poor performance due to excessive spin. In fact, this ratio for the club heads of Table 1 is less than 2.65.

As previously mentioned, the Delta1 values of the oversized club heads in Tables 1 and 2 are not ideal. In one present embodiment, preferred z-axis gear effect and trajectory are achieved in an oversize club head 2 when the Delta1 value is at least 15% of the face height Hss, while in a further embodiment the Delta1 value is at least 18% of the face height Hss, and in yet a further embodiment the Delta1 value is at least 20% of the face height Hss. In a further series of embodiments preferred performance is achieved when the Delta1 value lies within a tight range of relationships to face height Hss. For instance in one embodiment the Delta1 value is no more than 25% of the face height Hss, while in a further embodiment the Delta1 value is no more than 23% of the face height Hss. Similarly, in another embodiment the Delta2 value is at least 64% of the face height Hss, while in a further embodiment it is 64-70% of the face height Hss, and in yet an even further embodiment it is 64-68% of the face height Hss.

As with virtually every aspect of the disclosed oversized club head 2 embodiments, simply scaling up a conforming 460 cc club head to create an oversized club head 2 will not result in the best performing oversized club head 2 or one that is user friendly. In fact doing so is likely to produce a face height that so large that it is aesthetically undesirable, may suffer from durability issues, and may not increase the club head performance. An exceedingly tall face increases the likelihood of a novice golfer striking the ball below the geometric center of the face, negatively influencing the launch conditions. Thus, in one embodiment the face height Hss does not increase in proportion to the increased face area and/or volume, and has a face height Hss of no more than 70 mm. While in another embodiment the face height Hss is at least 62.5 mm, and in yet a further embodiment the face height Hss is at least 65 mm. Further embodiments have a face height Hss that is 63-70 mm, 64-68 mm, and 65-67 mm. Similarly, in one embodiment the face width Wss is at least 93 mm, with the face width Wss being at least 95 mm in another embodiment, at least 97.5 mm in a third embodiment, and at least 100 mm in yet another embodiment. Further embodiments recognize diminishing returns on face width Wss and have a face width Wss that is no more than 110 mm, no more than 105 mm, and no more than 100 mm, thereby producing a series of embodiments having preferential ranges that capitalize on increased volume and face area without introducing excessive drag, to produce an oversized club head 2 that is playable by a novice golfer, possesses good feel and stability, and is aesthetically pleasing. In a further embodiment the oversized club head 2 is defined as one having a center face height, or the vertical height of the ideal impact point 23 above the ground plane 17, as seen in FIG. 7, that is at least 32 mm, while in a further embodiment the center face height is at least 34 mm, and in an even further embodiment it is at least 36 mm. However, in another series of embodiment it was discovered that the center face height must be controlled to minimize the risk of a novice golfer striking the golf ball below the ideal impact point 23. Thus, in one such embodiment the center face height is no more than 46 mm, while in a further embodiment the center face height is no more than 42 mm.

In one embodiment the head weight of the oversized club head 2, including any weights, moveable or otherwise, and loft/lie adjustment sleeves/systems, is less than 210 grams. Often oversize club heads are in excess of 275 grams and therefore the associated golf club would need to be unusually short to provide a swing weight that feels comfortable to most golfers, as disclosed later in detail. Achieving the desired lightweight oversized golf club head 2 is no easy task, particularly when trying to achieve any of the other performance enhancing relationships and/or constructions disclosed herein. In another embodiment the head weight is less than 200 grams, while in a further embodiment the head weight is less than 190 grams. A particularly effective series of embodiments has identified a synergistic balance of the pros and cons of oversized lightweight club heads 2 in the range of 185-205 grams, while in an even further embodiment the head weight is 195-205 grams, and in an even further embodiment the head weight is 190-200 grams. One particular embodiment includes an adjustment system such as that disclosed in U.S. patent application Ser. Nos. 14/871,789, 14/939,648, 14/876,694, 14/587,573, 14/565,311, the entire contents of which are herein incorporated by reference.

In fact, another embodiment recognizes a unique relationship of the volume to the head weight that aids in defining a lightweight oversized golf club head 2 that feels natural to a golfer, inspires confidence, and yet is easy to control and stable throughout a golf swing, particularly when combined with one or more of the other performance enhancing relationships and/or constructions disclosed herein. In a first such embodiment a volume-to-head-weight ratio of the volume to the head weight is at least 3.5 cc/gram, which is over 50% greater than such a ratio for a traditional 460 cc and 200 gram conforming club head, and over 10% greater than competitive club heads A and B seen in Tables 1 and 2. In another embodiment the volume-to-head-weight ratio is at least 3.75 cc/gram. However, as with the previously discussed oversized club head 2 volume and weight, this volume-to-head-weight ratio cannot simply be maximized or minimized to continue to increase performance. Rather, a particularly effective series of embodiments has identified a synergistic balance of the pros and cons of oversized lightweight club heads 2 in the range of volume-to-head-weight ratios from 3.5-4.5 cc/gram, while in an even further embodiment the range is 3.75-4.25 cc/gram.

The method used to obtain the bulge and roll values in the present disclosure is the optical comparator method. The club face includes a series of score lines which traverse the width of the club face generally along the X-axis of the club head. In the optical comparator method, the club head is mounted face down and generally horizontal on a V-block mounted on an optical comparator. The club head is oriented such that the score lines are generally parallel with the X-axis of the optical comparator. Measurements are then taken at the geometric center point on the club face. Further measurements are then taken 20 millimeters away from the geometric center point of the club face on either side of the geometric center point 5*a* and along the X-axis of the club head, and 30 millimeters away from the geometric center point of the club face on either side of the center point and along the X-axis of the club head. An arc is fit through these five measure points, for example by using the radius function on the machine. This arc corresponds to the circumference of a circle with a given radius. This measurement of radius is what is meant by the bulge radius. In one embodiment of the present invention the bulge is at least 325 mm, while in a further embodiment it is at least 350 mm. Further, additional embodiments ensure the bulge does not become too large and negatively influence performance by having a bulge that is no more than 400 mm, and one particularly effective embodiment has a bulge that is 325-375 mm.

To measure the roll, the club head is rotated by 90 degrees such that the Z-axis of the club head is generally parallel to the X-axis of the machine. Measurements are taken at the geometric center point of the club face. Further measurements are then taken 15 millimeters away from the geometric center point and along the Z-axis of the club face on either side of the center point, and 20 millimeters away from the geometric center point and along the Z-axis of the club face on either side of the geometric center point. An arc is fit through these five measurement points. This arc corresponds to the circumference of a circle with a given radius. This measurement of radius is what is meant by the roll radius. In one embodiment of the present invention the roll is at least 325 mm, while in a further embodiment it is at least 350 mm. Further, additional embodiments ensure the roll does not become too large and negatively influence performance by having a roll that is no more than 400 mm, and one particularly effective embodiment has a roll that is 325-375 mm.

As previously expressed, aerodynamic drag associated with an oversized golf club head 2 is significant compared to a smaller conforming golf club head, to the point that it not only may reduce the swing speed but also impacts a golfers ability to consistently return the club face 18 to the square position at the time of impact with the golf ball. Therefore, the oversized club head 2 may incorporate any of the aerodynamic features, contours, and elements described in U.S. patent application Ser. Nos. 15/012,880, 14/789,263, 15/002,471, 14/330,205, 14/629,160, and others disclosed herein, which are incorporated herein by reference. Additionally, as explained in detail in U.S. patent application Ser. No. 15/255,638, which is incorporated herein by reference, preferential aerodynamic shaping of the body 10, and particularly the crown 12, tend to result in a high center of gravity 50 especially in an oversized club head, and thus a large Zup dimension. Further, as explained above, traditional oversized club heads have produced a moment of inertia about the golf club head CG z-axis 85, Izz, that is less than ideal. An embodiment of the present invention unexpectedly discovered that a unique relationship of the Zup value relative to ½ of the maximum club head height Hch provides a preferred balance of aerodynamic performance, launch characteristic performance, forgiveness, and feel, provided a sufficient Izz is maintained. One embodiment achieves a differential between the Zup value and ½ the value of the maximum club head height Hch that is less than −1.5 mm, while in another embodiment the differential is less than −3.0 mm, and in still a further embodiment the differential is less than −4.5 mm. The preferred balance of aerodynamic performance, launch characteristic performance, forgiveness, and feel, are further provided in embodiments with sufficient Izz; for example, one embodiment has an Izz value of at least 550 kg·mm$^2$ and achieves a differential between the Zup value and ½ the value of the maximum club head height Hch that is less than −4.0 mm. With reference to the oversized club head 2 embodiment of Tables 3 and 4, the Zup value is 33.3 mm, while half the club head height Hch is 0.5×75.8, which is 37.9 mm, and thus the differential is −4.6 mm, while obtaining an Izz value of 591 kg·mm$^2$. In a further embodiment the Izz value is at least 575 kg·mm$^2$ and achieves a differential between the Zup value and ½ the value of the maximum club head height Hch that is less than −5.0 mm; while in yet another embodiment the Izz value is at least 600 kg·mm$^2$ and achieves a differential between the Zup value and ½ the value of the maximum club head height Hch that is less than −6.0 mm. Another series of embodiments identifies a floor for the differential and a ceiling for the Izz value that lead to desirable improvements and avoid diminishing returns, here the differential between the Zup value and ½ the value of the maximum club head height Hch that is greater than −12.0 mm and the Izz value is no more than 700 kg·mm$^2$, while in a further embodiment the differential is greater than −10 mm and the Izz value is no more than 650 kg·mm$^2$.

Preferably, the overall frequency of the oversized golf club head 2, i.e., the average of the first mode frequencies of the crown 12, sole 14, and skirt 16 portions of the oversized club head 2, generated upon impact with a golf ball is greater than 3,000 Hz. Frequencies above 3,000 Hz provide a user of the oversized golf club with an enhanced feel and satisfactory auditory feedback, while in some embodiments frequencies above 3,200 Hz are obtained and preferred. However, an oversized golf club head 2 having relatively thin walls and/or a thin bulbous crown 12, can reduce the first mode vibration frequencies to undesirable levels. The oversized club head 2 may incorporate a plurality of ribs positioned on an internal surface to achieve the desired frequency, such as, but not limited to, those disclosed in U.S. patent application Ser. Nos. 14/525,540 and 14/284,813, which are incorporated herein by reference. In another embodiment the oversized club head 2 includes contrast enhancing features including any of those disclosed in U.S. patent application Ser. Nos. 14/302,817 and 14/638,829, which are incorporated herein by reference. In still a further embodiment the oversized club head 2 has a surface covering including any of those disclosed in U.S. patent application Ser. No. 14/803,735, which is incorporated herein by reference.

Logically the oversized club head 2 is attached to a shaft, often via an adjustability sleeve, with the shaft having a grip, to create an oversized golf club having a club length. The club length is measured according to the current edition of the United States Golf Association's "Procedure for Measuring the Length of Golf Clubs (Excluding Putters)." One skilled in the art is familiar with U.S. Pat. No. 1,953,916 titled "Apparatus for Measuring Moments of Golf Clubs and the Like," which discloses an instrument for measuring the amount of torque the weight of an object exerts about a pivoting fulcrum located 14" from the end of the object. This device is particularly well known in the field of golf equipment. In one embodiment, the oversized golf club has a club length of at least 43.5" and produces a torque of 5500-7000 gram*inches about a fulcrum located 14" from the butt end of the grip, which is easily measured using such a swing weight apparatus and roughly equates to a swing weight of C3 through E7 on what is commonly referred to as the "Lorythmic" scale. In another embodiment, the oversized golf club has a club length of at least 43.5" and produces a torque of 6050-6500 gram*inches about a fulcrum located 14" from the butt end of the grip, which is easily measured using such a swing weight apparatus and roughly equates to a swing weight of D0 through D9 on the "Lorythmic" scale, while in a further embodiment the club length is at least 44.0". In still a further embodiment the oversized golf club has a club length of at least 44.0" and produces a torque of 6050-6300 gram*inches about a fulcrum located 14" from the butt end of the grip, which is easily measured using such a swing weight apparatus and roughly equates to a swing weight of D0 through D5 on the "Lorythmic" scale.

Achieving a resistance to squaring an oversized club head 2 during the golf swing that is comfortable to the novice golfer, and feels like a conventional non-oversized golf club, and avoids a sense of instability during off-center impacts, is important and not easily achieved. This is achieved in part via establishing a proper center of gravity location to result in the desired magnitude of the Delta1 and Delta2 values, CG angle, moments of inertia, and the associated ratios, relationships, and club head mass property characteristics influenced by these variables, but they must take into account the significance that the overall bulk of the oversized club head 2 also plays in the increase in aerodynamic drag associated with large face area club heads, large face height Hss and/or widths Wss, large club head depths Dch, and/or large club head heights Hch. The disclosed relationships and ratios accomplish this delicate balance were not found through mere experimentation, as most of the disclosed relationships and ratios are not even considerations in convention non-oversized club head design, rather they were discovered to be surprisingly important and critical in the design of an oversized golf club head 2 and yielded unexpected results.

Discretionary Mass

Desired club head mass moments of inertia, club head center-of-gravity locations, and other mass properties of a golf club head can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass, as does lightweight non-metallic components, such as crown inserts, face inserts, sole inserts, and composite head components, as disclosed in U.S. patent application Ser. Nos. 14/734,181, 14/516,503, 14/717,864, 15/233,805, 15/087,002, and 62/205,601, the entire contents of which are incorporated herein by reference. A reduction in wall thickness reduces the wall mass and provides mass that can be distributed elsewhere. For example, in some implementations, one or more walls of the oversized club head 2 can have a thickness (constant or average) less than approximately 0.7 mm, such as between about 0.55 mm and about 0.65 mm. In some embodiments, the crown 12 can have a thickness (constant or average) of approximately 0.60 mm or approximately 0.65 mm throughout more than about 70% of the crown, with the remaining portion of the crown 12 having a thickness (constant or average) of approximately 0.76 mm or approximately 0.80 mm. In addition, the skirt 16 can have a similar thickness and the wall of the sole 14 can have a thickness of between approximately 0.6 mm and approximately 2.0 mm. In contrast, many conventional club heads have crown wall thicknesses in excess of about 0.75 mm, and some in excess of about 0.85 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

To achieve a thin wall on the club head body 10, such as a thin crown 12, a club head body 10 can be formed from an alloy of steel or an alloy of titanium. Thin wall investment casting, such as gravity casting in air for alloys of steel and centrifugal casting in a vacuum chamber for alloys of titanium, provides one method of manufacturing a club head body with one or more thin walls.

Weights and Weight Ports and Weight Channels

Various approaches can be used for positioning discretionary mass within a golf club head 2. For example, many club heads 2 have integral sole weight pads cast into the head at predetermined locations that can be used to lower, to move forward, to move rearward, or otherwise to adjust the location of the club head's center-of-gravity. Also, epoxy can be added to the interior of the club head through the club head's hosel opening to obtain a desired weight distribution. Alternatively, weights formed of high-density materials can be attached to the sole, skirt, and other parts of a club head, including channels formed within the body, on the body, and/or projecting from the body. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Alternatively, the golf club head 2 can define one or more weight ports or channels formed in the body 10 that are configured to receive one or more weights. For example, one or more weight ports can be disposed in the crown 12, skirt 16 and/or sole 14. The weight port and/or channel can have any of a number of various configurations to receive and retain any of a number of weights or weight assemblies, such as described in U.S. patent application Ser. Nos. 14/871,789, 14/939,648, 14/575,745, 14/266,608, 14/509,966, 14/843,605, 14/508,981, 14/861,881, 14/875,554, 14/789,838, 13/956,046, 15/004,509, 15/233,805, 15/087,002, and 62/205,601, and U.S. Pat. Nos. 7,407,447 and 7,419,441, which are incorporated herein by reference.

Coefficient of Restitution and Characteristic Time

Another parameter that contributes to the forgiveness and successful playability and desirable performance of a golf club 2 is the coefficient of restitution (COR) and Characteristic Time (CT) of the golf club head 2. Upon impact with a golf ball, the club head's face 18 deflects and rebounds, thereby imparting energy to the struck golf ball. The club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. It typically is desirable to incorporate thin walls and a thin face plate into the design of the club head. Thin walls and the incorporation of lightweight materials afford the designers additional leeway in distributing club head mass to achieve desired mass distribution, and a thinner face plate may provide for a relatively higher COR as well as provide more discretionary mass to achieve the desired mass distribution.

Thus, selective use of thin walls is important to a club's performance. However, overly thin walls can adversely affect the club head's durability. Problems also arise from stresses distributed across the club head upon impact with the golf ball, particularly at junctions of club head components, such as the junction of the face plate with other club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the club head. Thus, these club heads fail to provide optimal MOI, CG, and/or COR parameters, and as a result, fail to provide much forgiveness for off-center hits for all but the most expert golfers.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a club head with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved. The CG projection above center face of a golf club head can be measured directly, or it can be calculated from several measurable properties of the club head.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

The coefficient of restitution (COR) of a golf club may be increased by increasing the height Hs, of the striking face 18 and/or by decreasing the thickness of the striking face 18 of a golf club head 2. However, increasing the face height may be considered undesirable because doing so will potentially cause an undesirable change to the mass properties of the golf club and to the golf club's appearance. In another embodiment the performance of the oversized club head 2 is increased with the introduction of a channel, stress reducing feature, or boundary condition feature such as the ones disclosed in U.S. patent application Ser. Nos. 14/868,446, 14/658,267, 14/873,477, 14/939,648, 14/871,789, 14/573,701, and 14/457,883, which are incorporated herein by reference.

Whereas the invention has been described in connection with representative embodiments, it will be understood that the invention is not limited to those embodiments. On the contrary, the invention is intended to encompass all modifications, alternatives, and equivalents as may fall within the scope of the invention, as defined by the following claims.

We claim:

1. A golf club head, comprising:

a body defining an interior cavity, a sole portion positioned at a bottom portion of the golf club head, a crown portion positioned at a top portion of the golf club head, a forward portion and a rearward portion, a volume, and a face positioned at the forward portion and having an ideal impact location, a roll, a bulge, a face area of at least 5000 $mm^2$, a face height (FH) of no more than 70 mm, and a face width (FW);

the body includes an integrally formed cup-face portion having an insert opening and a return portion that forms a portion of the crown portion and the sole portion;

the face includes a non-metallic face insert bonded to the cup-face portion, wherein the non-metallic face insert has a face insert density of less than 3 g/cc and a face insert mass of less than 50 grams; and the golf club head has a head weight, a head height, a head width, a head depth that is greater than 85% of the club head width, a Delta1 value, a Delta2 value, a CG angle that is at least 14 degrees, a head origin x-axis (CGx) coordinate, a head origin y-axis (CGy) coordinate that is at least 25 mm, a head origin z-axis (CGz) coordinate, a Zup value of no more than 30 mm, a moment of inertia about a golf club head center-of-gravity x-axis, Ixx, that is 300-425 kg·$mm^2$, a moment of inertia about a golf club head center-of-gravity z-axis, Izz, that is at least 450 kg·$mm^2$, and a hosel axis moment of inertia, Ih; wherein:

a depth-to-Zup ratio of the head depth to the Zup value is at least 3.50;

a Ih-to-Zup ratio of the hosel axis moment of inertia, Ih, to the Zup value is at least 25 kg·mm; and a roll-to-FH ratio of the roll to the face height is at least 5.0.

2. The golf club head of claim 1, wherein the face area is no more than 7000 $mm^2$.

3. The golf club head of claim 2, wherein the depth-to-Zup ratio is no more than 5.25, the CG angle is no more than 34 degrees, and the head origin z-axis (CGz) coordinate is no more than 0 mm.

4. The golf club head of claim 3, wherein the Ih-to-Zup ratio is no more than 35 kg·mm.

5. The golf club head of claim 3, wherein the Izz moment of inertia is at least 525 kg·$mm^2$.

6. The golf club head of claim 3, wherein at least 75% of the crown portion is formed of non-metallic material having a crown density of less than 2 g/cc.

7. The golf club head of claim 6, wherein at least 50% of the surface area of a body located above a height of the ideal impact location is formed of non-metallic material.

8. The golf club head of claim 7, wherein a mass of the non-metallic material located above the height of the ideal impact location is 25-50 grams, and a surface area of the non-metallic material located above the height of the ideal impact location is at least 7500 $mm^2$.

9. The golf club head of claim 7, wherein at least 50% of the surface area of the body located below the height of the ideal impact location is formed of non-metallic material, and a mass of the non-metallic material located below the height of the ideal impact location is 10-25% of the head weight.

10. The golf club head of claim 3, wherein the roll-to-FH ratio is no more than 6.5.

11. The golf club head of claim 3, wherein a bulge-to-FW ratio of the bulge to the face width is 3.4-6.0.

12. The golf club head of claim 3, wherein a hosel axis ratio of the hosel axis moment of inertia, Ih, to the Delta1 value is at least 40 kg·mm.

13. The golf club head of claim 3, wherein a volume-to-FH ratio of the volume to the face height is at least 10 cc/mm.

14. The golf club head of claim 3, wherein a volume-to-Zup ratio of the volume to the Zup value is at least 18 cc/mm.

15. The golf club head of claim 3, wherein the Delta2 value is 24-31% of the head depth.

16. The golf club head of claim 3, wherein a volume-to-Delta2 ratio of the volume to the Delta2 value is at least 17 cc/mm.

17. The golf club head of claim 3, wherein a Delta ratio of the Delta2 value to the Delta1 value is 1.5-3.0.

18. A golf club head, comprising:

a body defining an interior cavity, a sole portion positioned at a bottom portion of the golf club head, a crown portion positioned at a top portion of the golf club head, a forward portion and a rearward portion, a volume, and a face positioned at the forward portion and having an ideal impact location, a roll, a bulge, a face area of 5000-7000 $mm^2$, a face height (FH) of no more than 70 mm, and a face width (FW);

the body includes an integrally formed cup-face portion having an insert opening and a return portion that forms a portion of the crown portion and the sole portion;

the face includes a non-metallic face insert bonded to the cup-face portion, wherein the non-metallic face insert has a face insert density of less than 3 g/cc and a face insert mass of less than 50 grams;

at least 75% of the crown portion is formed of non-metallic material having a crown density of less than 2 g/cc;

at least 50% of a surface area of the body located above a height of the ideal impact location is formed of non-metallic material, and a mass of the non-metallic material located above the height of the ideal impact location is 25-50 grams, and a surface area of the non-metallic material located above the height of the ideal impact location is at least 7500 $mm^2$;

at least 50% of the surface area of the body located below the height of the ideal impact location is formed of non-metallic material, and a mass of the non-metallic material located below the height of the ideal impact location is 10-25% of the head weight; and the golf club head has a head weight, a head height, a head width, a head depth that is greater than 85% of the club head width, a Delta1 value, a Delta2 value, a Delta ratio of the Delta2 value to the Delta1 value of 1.5-3.0, a CG angle that is 14-34 degrees, a head origin x-axis (CGx) coordinate, a head origin y-axis (CGy) coordinate that is at least 25 mm, a head origin z-axis (CGz) coordinate of no more than 0 mm, a Zup value of no more than 30 mm, a moment of inertia about a golf club head center-of-gravity x-axis, Ixx, that is 300-425 kg·$mm^2$, a moment of inertia about a golf club head center-of-gravity z-axis, Izz, that is at least 450 kg·$mm^2$, and a hosel axis moment of inertia, Ih; wherein:

a depth-to-Zup ratio of the head depth to the Zup value is 3.50-5.25;

a Ih-to-Zup ratio of the hosel axis moment of inertia, Ih, to the Zup value is 25-35 kg·mm; and a roll-to-FH ratio of the roll to the face height is at least 5.0.

19. The golf club head of claim 18, wherein the Izz moment of inertia is at least 525 kg·$mm^2$.

20. The golf club head of claim 19, wherein a volume-to-Zup ratio of the volume to the Zup value is at least 18 cc/mm.

* * * * *